US011184728B2

(12) United States Patent
Ertel et al.

(10) Patent No.: US 11,184,728 B2
(45) **Date of Patent: *Nov. 23, 2021**

(54) RENDERER CONTROLLED SPATIAL UPMIX

(71) Applicant: Fraunhofer-Gesellschaft zur Foerderung der angewandten Forschung e.V., Munich (DE)

(72) Inventors: Christian Ertel, Eckental (DE); Johannes Hilpert, Nuremberg (DE); Andreas Hoelzer, Erlangen (DE); Achim Kuntz, Hemhofen (DE); Jan Plogsties, Fuerth (DE); Michael Kratschmer, Fuerth (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/422,405

(22) Filed: May 24, 2019

(65) Prior Publication Data

US 2019/0281401 A1 Sep. 12, 2019

Related U.S. Application Data

(63) Continuation of application No. 15/854,967, filed on Dec. 27, 2017, now Pat. No. 10,341,801, which is a (Continued)

(30) Foreign Application Priority Data

Jul. 22, 2013 (EP) ..... 13177368
Oct. 18, 2013 (EP) ..... 13189285

(51) Int. Cl.

| | |
|---|---|
| ***G10L 19/008*** | (2013.01) |
| ***H04S 5/00*** | (2006.01) |
| ***H04S 7/00*** | (2006.01) |

(52) U.S. Cl.

CPC ..... *H04S 5/005* (2013.01); *G10L 19/008* (2013.01); *H04S 7/308* (2013.01); *H04S 5/00* (2013.01);

(Continued)

(58) Field of Classification Search

CPC ... H04S 5/00; H04S 5/005; H04S 7/00; H04S 7/308; H04S 2400/01; H04S 2400/03;

(Continued)

(56) References Cited

U.S. PATENT DOCUMENTS 8,170,882 B2 5/2012 Davis
8,515,759 B2 8/2013 Resch et al.

(Continued)

FOREIGN PATENT DOCUMENTS

CN 101809654 A 8/2010
CN 102165797 A 8/2011

(Continued)

OTHER PUBLICATIONS

ISO/IEC 23003-1, "Information Technology—MPEG Audio Technologies—Part 1: MPEG Surround", ISO/IEC 23003-1, Switzerland, Feb. 15, 2007, pp. 1-72.

(Continued)

*Primary Examiner* — Ping Lee

(74) *Attorney, Agent, or Firm* — Michael Glenn; Perkins Coie LLP

(57) ABSTRACT

An audio decoder device for decoding a compressed input audio signal having at least one core decoder having one or more processors for generating a processor output signal based on a processor input signal, wherein a number of output channels of the processor output signal is higher than a number of input channels of the processor input signal, wherein each of the one or more processors has a decorrelator and a mixer, wherein a core decoder output signal (Continued)

having a plurality of channels has the processor output signal, and wherein the core decoder output signal is suitable for a reference loudspeaker setup; at least one format converter device configured to convert the core decoder output signal into an output audio signal, which is suitable for a target loudspeaker setup; and a control device configured to control at least one or more processors in such way that the decorrelator of the processor may be controlled independently from the mixer of the processor, wherein the control device is configured to control at least one of the decorrelators of the one or more processors depending on the target loudspeaker setup.

15 Claims, 12 Drawing Sheets

Related U.S. Application Data continuation of application No. 15/004,659, filed on Jan. 22, 2016, now Pat. No. 10,085,104, which is a continuation of application No. PCT/EP2014/065037, filed on Jul. 14, 2014.

(52) U.S. Cl.
CPC ..... *H04S 2400/01* (2013.01); *H04S 2400/03* (2013.01); *H04S 2400/05* (2013.01); *H04S 2420/03* (2013.01)

(58) Field of Classification Search
CPC ..... H04S 2400/05; H04S 2420/03; G01L 19/008; G10L 19/008
See application file for complete search history.

(56) References Cited

U.S. PATENT DOCUMENTS

| | | | | |
|---|---|---|---|---|
| 8,824,689 | B2 | 9/2014 | Disch et al. | |
| 9,934,789 | B2 | 4/2018 | Kim et al. | |
| 10,085,104 | B2 * | 9/2018 | Ertel | H04S 5/005 |
| 10,341,801 | B2 * | 7/2019 | Ertel | H04S 7/308 |
| 2005/0232445 | A1 | 10/2005 | Vaudrey et al. | |
| 2006/0206323 | A1 | 9/2006 | Breebaart | |
| 2007/0223708 | A1 | 9/2007 | Villemoes et al. | |
| 2009/0010440 | A1 * | 1/2009 | Jung | G10L 19/008 381/1 |
| 2009/0012796 | A1 | 1/2009 | Jung et al. | |
| 2009/0110203 | A1 | 4/2009 | Taleb et al. | |
| 2010/0094631 | A1 * | 4/2010 | Engdegard | G10L 19/008 704/258 |
| 2010/0284549 | A1 | 11/2010 | Oh et al. | |
| 2011/0200196 | A1 | 8/2011 | Disch et al. | |
| 2011/0264456 | A1 | 10/2011 | Koppens et al. | |
| 2012/0039477 | A1 * | 2/2012 | Schijers | G10L 19/008 381/22 |
| 2013/0156200 | A1 * | 6/2013 | Kishi | G10L 19/008 381/17 |
| 2018/0132051 | A1 | 5/2018 | Villemoes | |

FOREIGN PATENT DOCUMENTS

| | | | |
|---|---|---|---|
| CN | 102176311 | A | 9/2011 |
| CN | 102348158 | A | 2/2012 |
| EP | 2175670 | A1 | 4/2010 |
| EP | 2500900 | A1 | 9/2012 |
| EP | 2225894 | B1 | 10/2012 |
| JP | 2006050241 | A | 2/2006 |
| JP | 2009526258 | A | 7/2009 |
| JP | 2009531735 | A | 9/2009 |
| JP | 2009531886 | A | 9/2009 |
| JP | 2010525403 | A | 7/2010 |
| JP | 2012505575 | A | 3/2012 |
| JP | 2012525051 | A | 10/2012 |
| JP | 2013125150 | A | 6/2013 |
| RU | 2363116 | C2 | 7/2009 |
| WO | 2007081164 | A1 | 7/2007 |
| WO | 2008049587 | A1 | 5/2008 |
| WO | 2011151771 | A1 | 12/2011 |

OTHER PUBLICATIONS

ISO/IEC 23003-3, "Information Technology—MPEG Audio Technologies—Part 3: Unified Speech and Audio Coding", ISO/IEC 23003-3, Switzerland, 2011, 286 pages.

Robjohns, Hugh, "You are Surrounded: Surround Sound Explained—Part 5", Soundonsound Magazine, http://www.soundonsound.com/sos/dec01/surround5.asp, Dec. 2001, pp. 1-10.

* cited by examiner

RENDERER CONTROLLED SPATIAL UPMIX

CROSS-REFERENCE TO RELATED APPLICATIONS

This application is a continuation of copending U.S. patent application Ser. No. 15/854,967, filed Dec. 27, 2017, which is a continuation of U.S. patent application Ser. No. 15/004,659, filed Jan. 22, 2016, now U.S. Pat. No. 10,085,104, which is a continuation of International Application No. PCT/EP2014/065037, filed Jul. 14, 2014, which claims priority from European Applications No. EP 13177368, filed Jul. 22, 2013 and European Application No. EP 13189285, filed Oct. 18, 2013, which are each incorporated herein by reference in their entirety.

BACKGROUND OF THE INVENTION

The present invention relates to audio signal processing, and, in particular, to format conversion of multi-channel audio signals.

Format conversion describes the process of mapping a certain number of audio channels into another representation suitable for playback via a different number of audio channels.

A common use case for format conversion is downmixing of audio channels. In Ref. [1] an example is given, wherein downmixing allows end-users to replay a version of the 5.1 source material even when a full 'home-theatre' 5.1 monitoring system is unavailable. Equipment designed to accept Dolby Digital material, but which provides only mono or stereo outputs (e.g. portable DVD players, set-top boxes and so forth), incorporates facilities to downmix the original 5.1 channels to the one or two output channels as standard.

On the other hand format conversion can also describe an upmix process e.g. upmixing stereo material to form a 5.1-compatible version. Also binaural rendering can be considered as format conversion.

In the following, implications of format conversion for the decoding process of compressed audio signals are discussed. Here, the compressed representation of the audio signal (mp4 file) represents a fixed number of audio channels intended for playback by a fixed loudspeaker setup.

The interaction between an audio decoder and subsequent format conversion into a desired playback format can be distinguished into three categories:

1. The decoding process is agnostic of the final playback scenario. Thus the full audio representation is retrieved and conversion processing is subsequently applied.

2. The audio decoding process is limited in its capabilities and will output a fixed format only. Examples are mono radios receiving stereo FM programs, or a mono HE-AAC decoder receiving a HE-AAC v2 bitstream.

3. The audio decoding process is aware of the final playback setup and adapts its processing accordingly. An example is the "Scalable Channel Decoding for Reduced Speaker Configurations" as defined for MPEG Surround in Ref. [2]. Here, the decoder reduces the number of output channels.

The disadvantages of these methods are unnecessary high complexity and potential artefacts by subsequent processing of decoded material (comb filtering for downmix, unmasking for upmix) (1.) and limited flexibility concerning the final output format (2. and 3.).

SUMMARY

According to an embodiment, an audio decoder device for decoding a compressed input audio signal may have: at least one core decoder having one or more processors for generating a processor output signal based on a processor input signal, wherein a number of output channels of the processor output signal is higher than a number of input channels of the processor input signal, wherein each of the one or more processors has a decorrelator and a mixer, wherein a core decoder output signal having a plurality of channels has the processor output signal, and wherein the core decoder output signal is suitable for a reference loudspeaker setup; at least one format converter device configured to convert the core decoder output signal into an output audio signal, which is suitable for a target loudspeaker setup; and a control device configured to control at least one or more processors in such way that the decorrelator of the processor may be controlled independently from the mixer of the processor, wherein the control device is configured to control at least one of the decorrelators of the one or more processors depending on the target loudspeaker setup.

According to another embodiment, a method for decoding a compressed input audio signal may have the steps of: providing at least one core decoder having one or more processors for generating a processor output signal based on a processor input signal, wherein a number of output channels of the processor output signal is higher than a number of input channels of the processor input signal, wherein each of the one or more processors has a decorrelator and a mixer, wherein a core decoder output signal having a plurality of channels has the processor output signal, and wherein the core decoder output signal is suitable for a reference loudspeaker setup; providing at least one format converter device configured to convert the core decoder output signal into an output audio signal, which is suitable for a target loudspeaker setup; and providing a control device configured to control at least one or more processors in such way that the decorrelator of the processor may be controlled independently from the mixer of the processor, wherein the control device is configured to control at least one of the decorrelators of the one or more processors depending on the target loudspeaker setup.

Another embodiment may have a computer program for implementing the above method when being executed on a computer or signal processor.

An audio decoder device for decoding a compressed input audio signal comprising at least one core decoder having one or more processors for generating a processor output signal based on a processor input signal, wherein a number of output channels of the processor output signal is higher than a number of input channels of the processor input signal, wherein each of the one or more processors comprises a decorrelator and a mixer, wherein a core decoder output signal having a plurality of channels comprises the processor output signal, and wherein the core decoder output signal is suitable for a reference loudspeaker setup;

at least one format converter configured to convert the core decoder output signal into an output audio signal, which is suitable for a target loudspeaker setup; and a control device configured to control at least one or more processors in such way that the decorrelator of the processor may be controlled independently from the mixer of the processor, wherein the control device is configured to control at least one of the decorrelators of the one or more processors depending on the target loudspeaker setup is provided.

The purpose of the processors is to create a processor output signal having a higher number of incoherent/uncorrelated channels than the number of the input channels of the processor input signal is. More particular, each of the processors generates a processor output signal with a plurality of incoherent/uncorrelated output channels, for example with two output channels, with the correct spatial cues from an processor input signal having a lesser number of input channels, for example from a mono input signal.

Such processors comprise a decorrelator and a mixer. The decorrelator is used to create a decorrelator signal from a channel of the processor input signal. Typically a decorrelator (decorrelation filter) consists of a frequency-dependent pre-delay followed by all-pass (IIR) sections.

The decorrelator signal and the respective channel of the processor input signal are then fed to the mixer. The mixer is configured to establish a processor output signal by mixing the decorrelator signal and the respective channel of the processor input signal, wherein side information is used in order to synthesize the correct coherence/correlation and the correct strength ratio of the output channels of the processor output signal.

The output channels of the processor output signal are then incoherent/uncorrelated so that the output channels of the processor would be perceived as independent sound sources if they were fed to different loudspeakers at different positions.

The format converter may convert the core decoder output signal to be suitable for playback on a loudspeaker setup which can differ from the reference loudspeaker setup. This setup is called target loudspeaker setup.

In case the output channels of one processor are not needed for a specific target loudspeaker set up by the subsequent format converter in an incoherent/uncorrelated form, the synthesis of the correct correlation becomes perceptually irrelevant. Hence, for these processors the decorrelator may be omitted. However, in general the mixer remains fully operational when the decorrelator is switched off. As a result the output channels of the processor output signal are generated even if the decorrelator is switched off.

It has to be noted that in this case the channels of the processor output signal are coherent/correlated but not identical. That means that the channels of the processor output signal may be further processed independently from each other downstream of the processor, wherein, for example, the strength ratio and/or other spatial information could be used by the format converter in order to set the levels of the channels of the output audio signal.

As decorrelation filtering entails substantial computational complexity, the overall decoding workload can largely be reduced by the proposed decoder device.

Although decorrelators, in particular their all pass filters, are designed in a way to have minimum impact on the subjective sound quality, it may not be avoided that audible artifacts are introduced, e.g. smearing of transients due to phase distortions or "ringing" of certain frequency components. Therefore, an improvement of audio sound quality can be achieved, as side effects of the decorrelator process are omitted.

Note that this processing shall only be applied for frequency bands where decorrelation is applied. Frequency bands where residual coding is used are not affected.

In embodiments the control device is configured to deactivate at least one or more processors so that input channels of the processor input signal are fed to output channels of the processor output signal in an unprocessed form. By this feature the number of channels, which are not identical, may be reduced. This might be advantageous, if the target loudspeaker set up comprises a number of loudspeakers, which is very small compared to the number of loudspeakers of the reverence loudspeaker set up.

In advantageous embodiments the processor is a one input two output decoding tool (OTT), wherein the decorrelator is configured to create a decorrelated signal by decorrelating at least one channel of the processor input signal, wherein the mixer mixes the processor input audio signal and the decorrelated signal based on a channel level difference (CLD) signal and/or an inter-channel coherence (ICC) signal, so that the processor output signal consists of two incoherent output channels. Such one input to output decoding tools allow creating a processor output signal with pair of channels, which have the correct amplitude and coherence with respect to each other in an easy way.

In some embodiments the control device is configured to switch off the decorrelator of one of the processors by setting the decorrelated audio signal to zero or by preventing the mixer to mix the decorrelated signal into the processor output signal of the respective processor. Both methods allow switching off the decorrelator in an easy way.

In embodiments the core decoder is a decoder for both music and speech, such as an USAC decoder, wherein the processor input signal of at least one of the processors contains channel pair elements, such as USAC channel pair elements. In this case it is possible to omit decoding of the channel pair elements, if this is not necessary for the current target loudspeaker setup. In this way computational complexity and artifacts originating from the decorrelation process as well as from the downmix process may be reduced significantly.

In some embodiments the core decoder is a parametric object coder, such as a SAOC decoder. In this way computational complexity and artifacts originating from the decorrelation process as well as from the downmix process may be reduced further.

In some embodiments the number of loudspeakers of a reference loudspeaker setup is higher than a number of loudspeakers of the target loudspeaker setup. In this case the format converter may downmix the core decoder output signal to an audio to the output audio signal, wherein the number of the output channels is smaller than the number of output channels of the core decoder output signal.

Here, downmixing describes the case when a higher number of loudspeakers is present in the reference loudspeaker setup than is used in the target loudspeaker setup. In such cases output channels of one or more processors are often not needed in the form of incoherent signals. If the decorrelators of such processors are switched off, computational complexity and artifacts originating from the decorrelation process as well as from the downmix process may be reduced significantly.

In some embodiments the control device is configured to switch off the decorrelators for at least one first of said output channels of the processor output signal and one second of said output channels of the processor output signal, if the first of said output channels and the second of said output channels are, depending on the target loudspeaker setup, mixed into a common channel of the output audio signal, provided a first scaling factor for mixing the first of said output channels of the processor output signal into the common channel exceeds a first threshold and/or a second scaling factor for mixing the second of said output channels of the processor output signal into the common channel exceeds a second threshold.

In case the first of said output channels and the second of said output channels are mixed into a common channel of the output audio signal, decorrelation at the core decoder may be omitted for the first and the second output channel. In this way computational complexity and artifacts originating from the decorrelation process as well as from the downmix process may be reduced significantly. In this way unnecessary decorrelation may be avoided.

In a more advanced embodiment of first scaling factor for mixing the first of said output channels of the processor output signal may be foreseen. In the same way a second scaling factor for mixing the second of said output channels of processor output signal may be used. Herein a scaling factor is a numerical value, usually between zero and one, which describes the ratio between the signal strength in the original channel (output channel of the processor output signal) and the signal strength of the resulting signal in the mixed channel (common channel of the output audio signal). The scaling factors may be contained in a downmix matrix. By using a first threshold for the first scaling factor and/or by using a second threshold for the second scaling factor it may be ensured that decorrelation for the first output channel and the second output channel is only switched off, if at least a determined portion of the first output channel and/or at least a determined portion of the second output channel are mixed into the common channel. As an example the threshold may be set to zero.

In embodiments the control device is configured to receive a set of rules from the format converter according to which the format converter mixes the channels of the processor output signal into the channels of the output audio signal depending on the target loudspeaker setup, wherein the control device is configured to control processors depending on the received set of rules. Herein, the control of the processors may include the control of the decorrelators and/or of the mixers. By this feature it may be ensured that the control device controls the processors in an accurate manner.

By the set of rules, information whether the output channels of a processor are combined by a subsequent format conversion step may be provided to the control device. The rules received by the control device are typically in the form of a downmix matrix defining scaling factors for each decoder output channel to each audio output channel used by the format converter. In a next step control rules for controlling the decorrelators may be calculated by the control device from the downmix rules. This control rules may be contained in a so called mix matrix, which may be generated by the control device depending on the target loudspeaker setup. This control rules may then be used to control the decorrelators and/or the mixers. As a result, the control device can be adapted to different target loudspeaker setups without manual intervention.

In embodiments the control device is configured to control the decorrelators of the core decoder in such way that a number of incoherent channels of the core decoder output signal is equal to the number of loudspeakers of the target loudspeaker setup. In this case computational complexity and artifacts originating from the decorrelation process as well as from the downmix process may be reduced significantly.

In embodiments the format converter comprises a downmixer for downmixing the core decoder output signal. The downmixer made directly produce the output audio signal. However, in some embodiments the downmixer may be connected to another element of the format converter, which then produces the output audio signal.

In some embodiments the format converter comprises a binaural renderer. Binaural renderers are generally used to convert a multichannel signal into a stereo signal adapted for the use with stereo headphones. The binaural renderer produces a binaural downmix of the signal fed to it, such that each channel of this signal is represented by a virtual sound source. The processing may be conducted frame-wise in a quadrature mirror filter (QMF) domain. The binauralization is based on measured binaural room impulse responses and causes extremely high computational complexity, which correlates with the number of incoherent/uncorrelated channels of the signal fed to the binaural renderer.

In embodiments the core decoder output signal is fed the binaural renderer as a binaural renderer input signal. In in this case the control device usually is configured to control the processors of the core decoder in such way that a number of the channels of the core decoder output signal is greater as the number of loudspeakers of the headphones. This may be desired, as for example, the binaural renderer may use the spatial sound information contained in the channels for adjusting the frequency characteristics of the stereo signal fed to the headphones in order to generate a three-dimensional audio impression.

In some embodiments a downmixer output signal of the downmixer is fed to the binaural renderer as a binaural renderer input signal. In case that the output audio signal of the downmixer is fed to the binaural renderer, the number of channels of its input signal is significantly smaller than in cases, in which the core decoder output signal is fed to the binaural renderer, so that computational complexity is reduced.

Furthermore, a method for decoding a compressed input audio signal, the method comprising the steps: providing at least one core decoder having one or more processors for generating a processor output signal based on a processor input signal, wherein a number of output channels of the processor output signal is higher than a number of input channels of the processor input signal, wherein each of the one or more processors comprises a decorrelator and a mixer, wherein a core decoder output signal having a plurality of channels comprises the processor output signal, and wherein the core decoder output signal is suitable for a reference loudspeaker setup; providing at least one format converter configured to convert the core decoder output signal into an output audio signal, which is suitable for a target loudspeaker setup; and providing a control device configured to control at least one or more processors in such way that the decorrelator of the processor may be controlled independently from the mixer of the processor, wherein the control device is configured to control at least one of the decorrelators of the one or more processors depending on the target loudspeaker setup is provided.

Moreover, a computer program for implementing the method mentioned above when being executed on a computer or signal processor is provided.

BRIEF DESCRIPTION OF THE DRAWINGS

In the following, embodiments of the present invention are described in more detail with reference to the figures, in which.

DETAILED DESCRIPTION OF THE INVENTION

Before describing embodiments of the present invention, more background on state-of-the-art-encoder-decoder-systems is provided.

Figure 11:
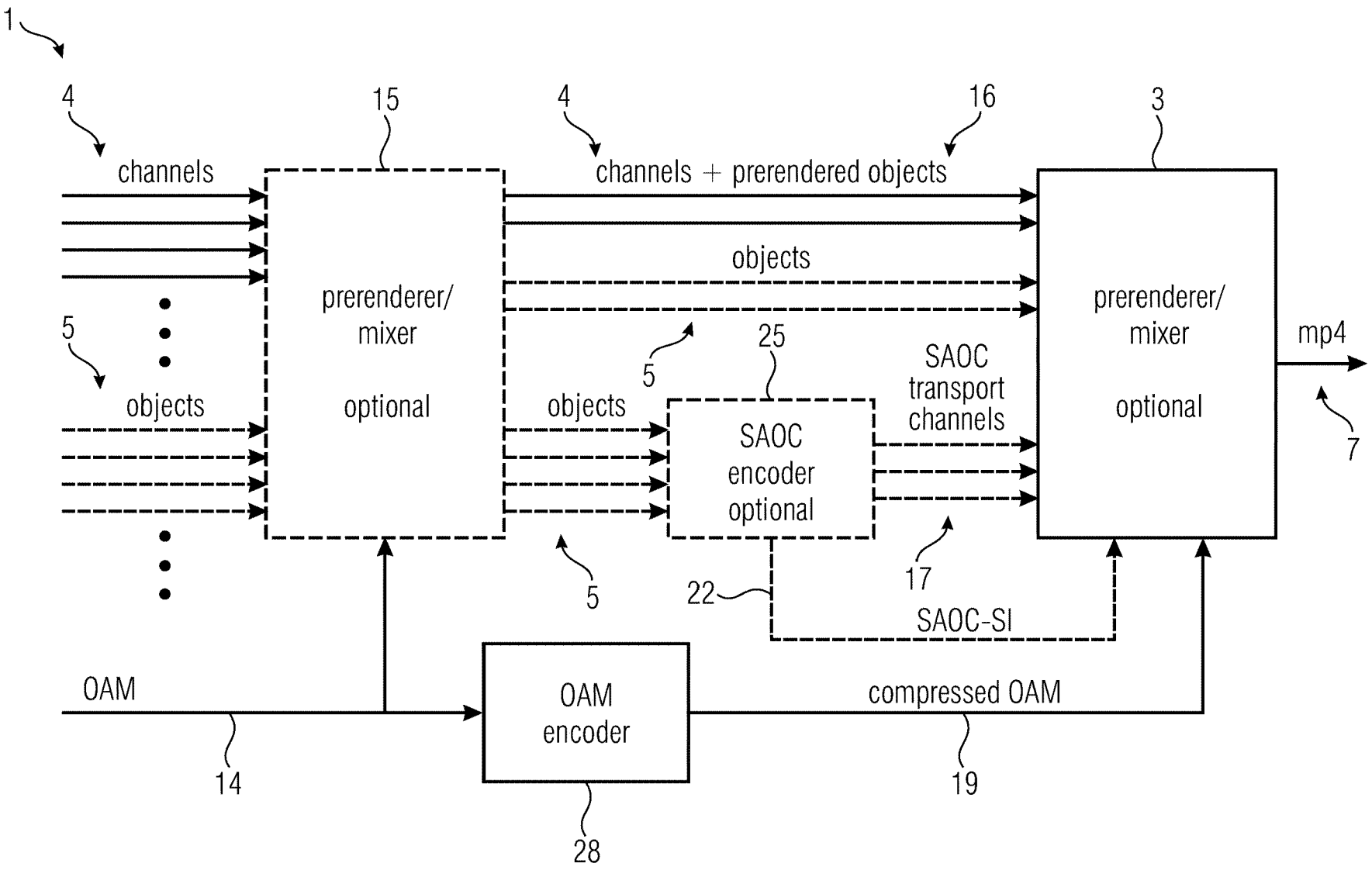
FIG. 11 shows a schematic block diagram of a conceptual overview of a 3D-audio encoder.
Figure 12:
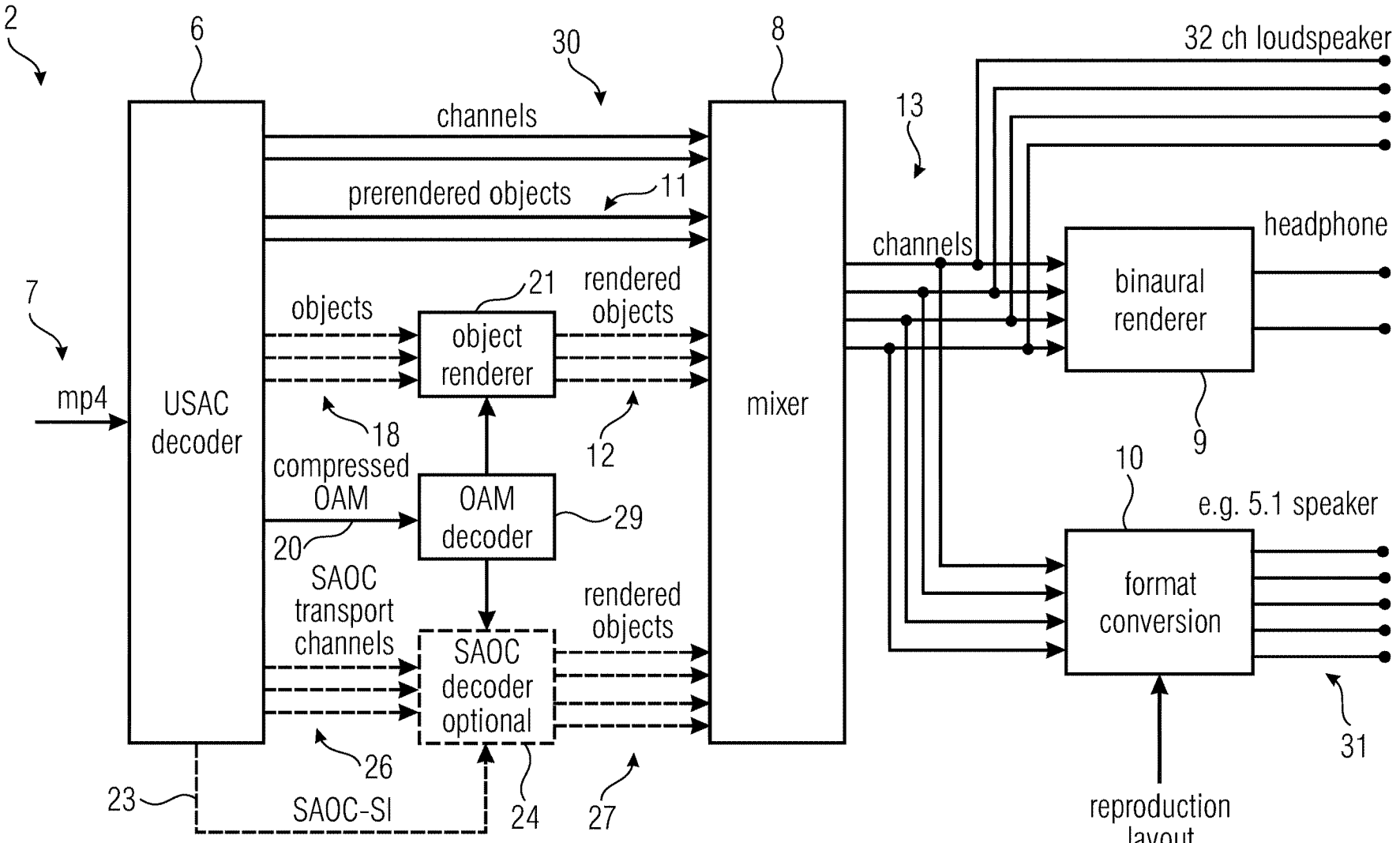
FIG. 12 shows a schematic block diagram of a conceptual overview of a 3D-audio decoder and FIG. 13 shows a schematic block diagram of a conceptual overview of a format converter.

FIG. 11 shows a schematic block diagram of a conceptual overview of a 3D-audio encoder 1, whereas FIG. 12 shows a schematic block diagram of a conceptual overview of a 3D-audio decoder 2.

The 3D Audio Codec System 1, 2 may be based on a MPEG-D unified speech and audio coding (USAC) encoder 3 for coding of channel signals 4 and object signals 5 as well as based on a MPEG-D unified speech and audio coding (USAC) decoder 6 for decoding of the output audio signal 7 of the encoder 3. To increase the efficiency for coding a large amount of objects 5, spatial audio object coding (SAOC) technology has been adapted. Three types of renderers 8, 9, 10 perform the tasks of rendering objects 11, 12 to channels 13, rendering channels 13 to headphones or rendering channels to a different loudspeaker setup.

When object signals are explicitly transmitted or parametrically encoded using SAOC, the corresponding Object Metadata (OAM) 14 information is compressed and multiplexed into the 3D-Audio bitstream 7.

The prerenderer/mixer 15 can be optionally used to convert a channel-and-object input scene 4, 5 into a channel scene 4, 16 before encoding. Functionally it is identical to the object renderer/mixer 15 described below.

Prerendering of objects 5 ensures deterministic signal entropy at the input of the encoder 3 that is basically independent of the number of simultaneously active object signals 5. With prerendering of objects 5, no object metadata 14 transmission is necessitated.

Discrete object signals 5 are rendered to the channel layout that the encoder 3 is configured to use. The weights of the objects 5 for each channel 16 are obtained from the associated object metadata 14.

The core codec for loudspeaker-channel signals 4, discrete object signals 5, object downmix signals 14 and prerendered signals 16 may be based on MPEG-D USAC technology. It handles the coding of the multitude of signals 4, 5, 14 by creating channel- and object mapping information based on the geometric and semantic information of the input's channel and object assignment. This mapping information describes, how input channels 4 and objects 5 are mapped to USAC-channel elements, namely to channel pair elements (CPEs), single channel elements (SCEs), low frequency enhancements (LFEs), and the corresponding information is transmitted to the decoder 6.

All additional payloads like SAOC data 17 or object metadata 14 may be passed through extension elements and may be considered in the rate control of the encoder 3.

The coding of objects 5 is possible in different ways, depending on the rate/distortion requirements and the interactivity requirements for the renderer. The following object coding variants are possible:

- Prerendered objects 16: Object signals 5 are prerendered and mixed to the channel signals 4, for example to 22.2 channels signals 4, before encoding. The subsequent coding chain sees 22.2 channel signals 4.
- Discrete object waveforms: Objects 5 are supplied as monophonic waveforms to the encoder 3. The encoder 3 uses single channel elements (SCEs) to transmit the objects 5 in addition to the channel signals 4. The decoded objects 18 are rendered and mixed at the receiver side. Compressed object metadata information 19, 20 is transmitted to the receiver/renderer 21 alongside.
- Parametric object waveforms 17: Object properties and their relation to each other are described by means of SAOC parameters 22, 23. The down-mix of the object signals 17 is coded with USAC. The parametric information 22 is transmitted alongside. The number of downmix channels 17 is chosen depending on the number of objects 5 and the overall data rate. Compressed object metadata information 23 is transmitted to the SAOC renderer 24.

The SAOC encoder 25 and decoder 24 for object signals 5 are based on MPEG SAOC technology. The system is capable of recreating, modifying and rendering a number of audio objects 5 based on a smaller number of transmitted channels 7 and additional parametric data 22, 23, such as object level differences (OLDs), inter-object correlations (IOCs) and downmix gain values (DMGs). The additional parametric data 22, 23 exhibits a significantly lower data rate than necessitated for transmitting all objects 5 individually, making the coding very efficient.

The SAOC encoder 25 takes as input the object/channel signals 5 as monophonic waveforms and outputs the parametric information 22 (which is packed into the 3D-Audio bitstream 7) and the SAOC transport channels 17 (which are encoded using single channel elements and transmitted). The SAOC decoder 24 reconstructs the object/channel signals 5 from the decoded SAOC transport channels 26 and parametric information 23, and generates the output audio scene 27 based on the reproduction layout, the decompressed object metadata information 20 and optionally on the user interaction information.

For each object 5, the associated object metadata 14 that specifies the geometrical position and volume of the object in 3D space is efficiently coded by an object metadata encoder 28 by quantization of the object properties in time and space. The compressed object metadata (cOAM) 19 is transmitted to the receiver as side information 20 which may be decoded bei an OAM-Decoder 29.

The object renderer 21 utilizes the compressed object metadata 20 to generate object waveforms 12 according to the given reproduction format. Each object 5 is rendered to certain output channels 12 according to its metadata 19, 20. The output of this block 21 results from the sum of the partial results. If both channel based content 11, 30 as well as discrete/parametric objects 12, 27 are decoded, the channel based waveforms 11, 30 and the rendered object waveforms 12, 27 are mixed before outputting the resulting waveforms 13 (or before feeding them to a postprocessor module 9, 10 like the binaural renderer 9 or the loudspeaker renderer module 10) by a mixer 8.

The binaural renderer module 9 produces a binaural downmix of the multi-channel audio material 13, such that each input channel 13 is represented by a virtual sound source. The processing is conducted frame-wise in a quadrature mirror filter (QMF) domain. The binauralization is based on measured binaural room impulse responses.

Figure 13:
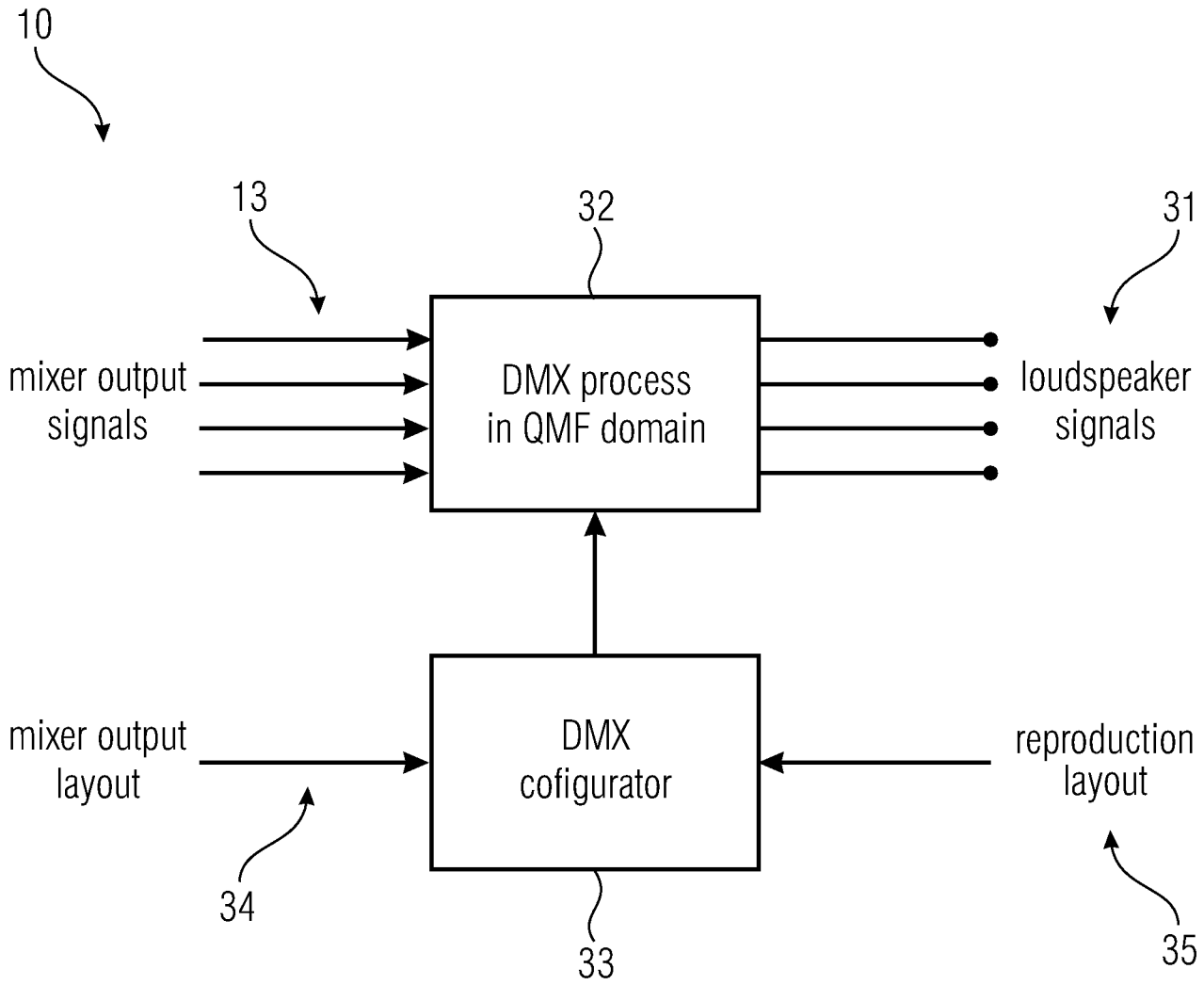

The loudspeaker renderer 10 shown in FIG. 13 in more details converts between the transmitted channel configuration 13 and the desired reproduction format 31. It is thus called 'format converter' 10 in the following. The format converter 10 performs conversions to lower numbers of output channels 31, i.e. it creates downmixes by a downmixer 32. The DMX configurator 33 automatically generates optimized downmix matrices for the given combination of input formats 13 and output formats 31 and applies these matrices in a downmix process 32, wherein a mixer output layout 34 and a reproduction layout 35 is used. The format converter 10 allows for standard loudspeaker configurations as well as for random configurations with non-standard loudspeaker positions.

Figure 1:
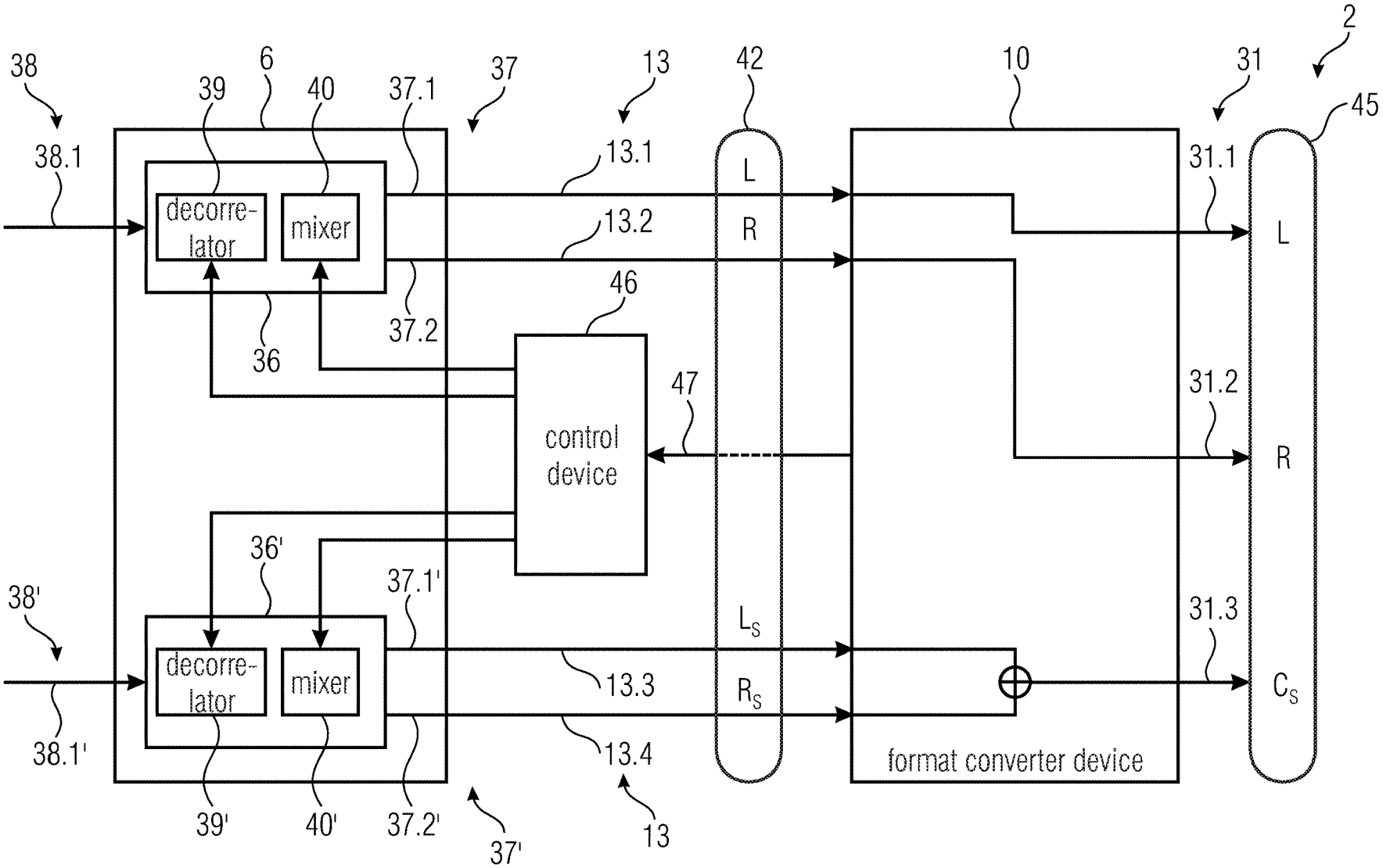
FIG. 1 shows a block diagram of an embodiment of a decoder according to the invention.

FIG. 1 shows a block diagram of an embodiment of a decoder 2 according to the invention.

The audio decoder device 2 for decoding a compressed input audio signal 38, 38' comprises at least one core decoder 6 having one or more processors 36, 36' for generating a processor output signal 37, 37' based on the processor input signal 38, 38', wherein a number of output channels 37.1, 37.2, 37.1', 37.2' of the processor output signal 37, 37' is higher than a number of input channels 38.1, 38.1' of the processor input signal 38, 38', wherein each of the one or more processors 36, 36' comprises a decorrelator 39, 39' and a mixer 40, 40', wherein a core decoder output signal 13 having a plurality of channels 13.1, 13.2, 13.3, 13.4 comprises the processor output signal 37, 37', and wherein the core decoder output signal 13 is suitable for a reference loudspeaker setup 42.

Further, the audio decoder device 2 comprises at least one format converter device 9, 10 configured to convert the core decoder output signal 13 into an output audio signal 31, which is suitable for a target loudspeaker setup 45.

Moreover, the audio decoder device 2 comprises a control device 46 configured to control at least one or more processors 36, 36' in such way that the decorrelator 39, 39' of the processor 36, 36' may be controlled independently from the mixer 40, 40' of the processor 36, 36', wherein the control device 46 is configured to control at least one of the decorrelators 39, 39' of the one or more processors 36, 36' depending on the target loudspeaker setup is provided.

The purpose of the processors 36, 36' is to create a processor output signal 37, 37' having a higher number of incoherent/uncorrelated channels 37.1, 37.2, 37.1', 37.2 than the number of the input channels 38.1, 38.1' of the processor input signal 38 is. More particular, each of the processors 36, 36' may generate a processor output signal 37 with a plurality of incoherent/uncorrelated output channels 37.1, 37.2, 37.1', 37.2' with the correct spatial cues from an processor input signal 38, 38' having a lesser number of input channels 38.1, 38.1'.

In the embodiment shown in FIG. 1 a first processor 36 has two output channels 37.1, 37.2, which are generated from a mono input signal 38 and a second processor 36' has two output channels 37.1', 37.2', which are generated from a mono input signal 38'.

The format converter device 9, 10 may convert the core decoder output signal 13 to be suitable for playback on a loudspeaker setup 45 which can differ from the reference loudspeaker setup 42. This setup is called target loudspeaker setup 45.

In the embodiment of FIG. 1 the reference loudspeaker setup 42 comprises a left front loudspeaker (L), a right front loudspeaker (R), a left surround loudspeaker (LS) and a right surround loudspeaker (RS). Further, the target loudspeaker setup 42 comprises a left front loudspeaker (L), a right front loudspeaker (R) and a center surround loudspeaker (CS).

In case the output channels 37.1, 37.2, 37.1', 37.2' of one processor 36, 36' are not needed for a specific target loudspeaker set up 45 by the subsequent format converter device 9, 10 in an incoherent/uncorrelated form, the synthesis of the correct correlation becomes perceptually irrelevant. Hence, for these processors 36, 36' the decorrelator 39, 39' may be omitted. However, in general the mixer 40, 40' remains fully operational when the decorrelator is switched off. As a result the output channels 37.1, 37.2, 37.1', 37.2' of the processor output signal are generated even if the decorrelator 39, 39' is switched off.

It has to be noted that in this case the channels 37.1, 37.2, 37.1', 37.2' of the processor output signal 37, 37' are coherent/correlated but not identical. That means that the channels 37.1, 37.2, 37.1', 37.2' of the processor output signal 37, 37' may be further processed independently from each other downstream of the processor 36, 36', wherein, for example, the strength ratio and/or other spatial information could be used by the format converter device 9, 10 in order to set the levels of the channels 31.1, 31.2, 31.3 of the output audio signal 31.

As decorrelation filtering necessitates substantial computational complexity, the overall decoding workload can largely be reduced by the proposed decoder device 2.

Although decorrelators 39, 39', in particular their all pass filters, are designed in a way to have minimum impact on the subjective sound quality, it may not be avoided that audible artifacts are introduced, e.g. smearing of transients due to phase distortions or "ringing" of certain frequency components. Therefore, an improvement of audio sound quality can be achieved, as side effects of the omitted decorrelator process.

Note that this processing shall only be applied for frequency bands where decorrelation is applied. Frequency bands where residual coding is used are not affected.

In embodiments the control device 46 is configured to deactivate at least one or more processors 36, 36' so that input channels 38.1, 38.1' of the processor input signal 38 are fed to output channels 37.1, 37.2, 37.1', 37.2' of the processor output signal 37, 37' in an unprocessed form. By this feature the number of channels, which are not identical, may be reduced. This might be advantageous, if the target loudspeaker set up 45 comprises a number of loudspeakers, which is very small compared to the number of loudspeakers of the reverence loudspeaker set up 42.

In embodiments the core decoder 6 is a decoder 6 for both music and speech, such as an USAC decoder 6, wherein the processor input signal 38, 38' of at least one of the processors contains channel pair elements, such as USAC channel pair elements. In this case it is possible to omit decoding of the channel pair elements, if this is not necessary for the current target loudspeaker setup 45. In this way computational complexity and artifacts originating from the decorrelation process as well as from the downmix process may be reduced significantly.

In some embodiments the core decoder is a parametric object coder 24, such as a SAOC decoder 24. In this way computational complexity and artifacts originating from the decorrelation process as well as from the downmix process may be reduced further.

In some embodiments the number of loudspeakers of a reference loudspeaker setup 42 is higher than a number of loudspeakers of the target loudspeaker setup 45. In this case the format converter device 9, 10 may downmix the core decoder output signal 13 to an audio to the output audio signal 31, wherein the number of the output channels 31.1, 31.2, 31.3 is smaller than the number of output channels 13.1, 13.2, 13.3, 13.4 of the core decoder output signal 13.

Here, downmixing describes the case when a higher number of loudspeakers is present in the reference loudspeaker setup 42 than is used in the target loudspeaker setup 45. In such cases output channels 37.1, 37.2, 37.1', 37.2' of one or more processors 36, 36' are often not needed in the form of incoherent signals. In FIG. 1 four decoder output channels 13.1, 13.2, 13.3, 13.4 of the core decoder output signal 13 exist, but only three output channels 31.1, 31.2, 31.3 of the audio output signal 31. If the decorrelators 39, 39' of such processors 36, 36' are switched off, computational complexity and artifacts originating from the decorrelation process as well as from the downmix process may be reduced significantly.

For reasons explained below, the decoder output channels 13.3 and 13.4 in FIG. 1 are not needed in the form of incoherent signals. Therefore, the decorrelator 39' is switched off by the control device 46, whereas the decorrelator 39 and the mixers 40, 40' are switched on.

In some embodiments the control device 46 is configured to switch off the decorrelators 39' for at least one first of said output channels 37.1' of the processor output signal 37, 37' and one second of said output channels 37.2, 37.2' of the processor output signal 37, 37', if the first of said output channels 37.1' and the second of said output channels 37.2' are, depending on the target loudspeaker setup 45, mixed into a common channel 31.3 of the output audio signal 31, provided a first scaling factor for mixing the first of said output channels 37.1' of the processor output signal 37' into the common channel 31.3 exceeds a first threshold and/or a second scaling factor for mixing the second of said output channels 37.2' of the processor output signal 37' into the common channel 31.3 exceeds a second threshold.

In FIG. 1. the decoder output channels 13.3 and 13.4 are mixed in a common channel 31.3 of the output audio signal 31. The first and the second scaling factor may be 0.7071. As a first and a second threshold in this embodiment are set to zero their decorrelator 39' is switched off.

In case the first of said output channels 37.1' and the second of said output channels 37.2' are mixed into a common channel 31.3 of the output audio signal 31, decorrelation at the core decoder 6 may be omitted for the first and the second output channel 37.1', 37.2'. In this way computational complexity and artifacts originating from the decorrelation process as well as from the downmix process may be reduced significantly. In this way unnecessary decorrelation may be avoided.

In a more advanced embodiment of first scaling factor for mixing the first of said output channels 37.1' of the processor output signal 37' may be foreseen. In the same way a second scaling factor for mixing the second of said output channels 37.2' of processor output signal 37' may be used. Herein a scaling factor is a numerical value, usually between zero and one, which describes the ratio between the signal strength in the original channel (output channel 37.1', 37.2' of the processor output signal 37') and the signal strength of the resulting signal in the mixed channel (common channel 31.1 of the output audio signal 31). The scaling factors may be contained in a downmix matrix. By using a first threshold for the first scaling factor and/or by using a second threshold for the second scaling factor it may be ensured that decorrelation for the first output channel 37.1' and the second output channel 37.2' is only switched off, if at least a determined portion of the first output channel 37.1' and/or at least a determined portion of the second output channel 37.2' are mixed into the common channel 31.3. As an example the thresholds may be set to zero.

In the embodiment of FIG. 1 the decoder output channels 13.3 and 13.4 are mixed in a common channel 31.3 of the output audio signal 31. The first and the second scaling factor may be 0.7071. As a first and a second threshold in this embodiment are set to zero their decorrelator 39' is switched off.

In embodiments the control device 46 is configured to receive a set of rules 47 from the format converter device 9, 10 according to which the format converter device 9, 10 mixes the channels 37.1, 37.2, 37.1', 37.2' of the processor output signal 37, 37' into the channels 31.1, 31.2, 31.3 of the output audio signal 31 depending on the target loudspeaker setup 45, wherein the control device 46 is configured to control processors 36, 36' depending on the received set of rules 47. Herein, the control of the processors 36, 36' may include control of the decorrelators 39, 39' and/or of the mixers 40, 40'. By this feature it may be ensured that the control device 46 controls the processors 36, 36' in an accurate manner.

By the set of rules 47, information whether the output channels of a processor 36, 36' are combined by a subsequent format conversion step may be provided to the control device 9, 10. The rules received by the control device 46 are typically in the form of a downmix matrix defining scaling factors for each core decoder output channel 13.1, 13.2, 13.3, 13.4 to each audio output channel 31.1, 31.2, 31.3 used by the format converter device 9, 10. In a next step control rules for controlling the decorrelators may be calculated by the control device from the downmix rules. This control rules may be contained in a so called mix matrix, which may be generated by the control device 46 depending on the target loudspeaker setup 45. This control rules may then be used to control the decorrelators 39, 39' and/or the mixers 40, 40'. As a result, the control device 46 can be adapted to different target loudspeaker setups 45 without manual intervention.

In FIG. 1 the set of rules 47 may contain the information that the decoder output channels 13.3 and 13.4 are mixed in a common channel 31.3 of the output audio signal 31. This may be done in the embodiment of FIG. 1 as the left surround loudspeaker and the right surround loudspeaker of the reference loudspeaker setup 42 are replaced by a center surround loudspeaker in the target loudspeaker setup 45.

In embodiments the control device 46 is configured to control the decorrelators 39, 39' of the core decoder 6 in such way that a number of incoherent channels of the core decoder output signal 13 is equal to the number of loudspeakers of the target loudspeaker setup 45. In this case computational complexity and artifacts originating from the decorrelation process as well as from the downmix process may be reduced significantly.

For example, in FIG. 1 three incoherent channels exist, the first is the decoder output channel 13.1, the second is the decoder output channel 13.2 and the third is each of the decoder output channels 13.3 and 13.4, as the decoder output channels 13.3 and 13.4 are coherent due to omitting decorrelator 39'.

In embodiments, such as in the embodiment of FIG. 1, the format converter device 9, 10 comprises a downmixer 10 for downmixing the core decoder output signal 13. The downmixer 10 may directly produce the output audio signal 31 as shown in FIG. 1. However, in some embodiments the downmixer 10 may be connected to another element of the format converter 10, such as a binaural renderer 9, which then produces the output audio signal 31.

Figure 2:
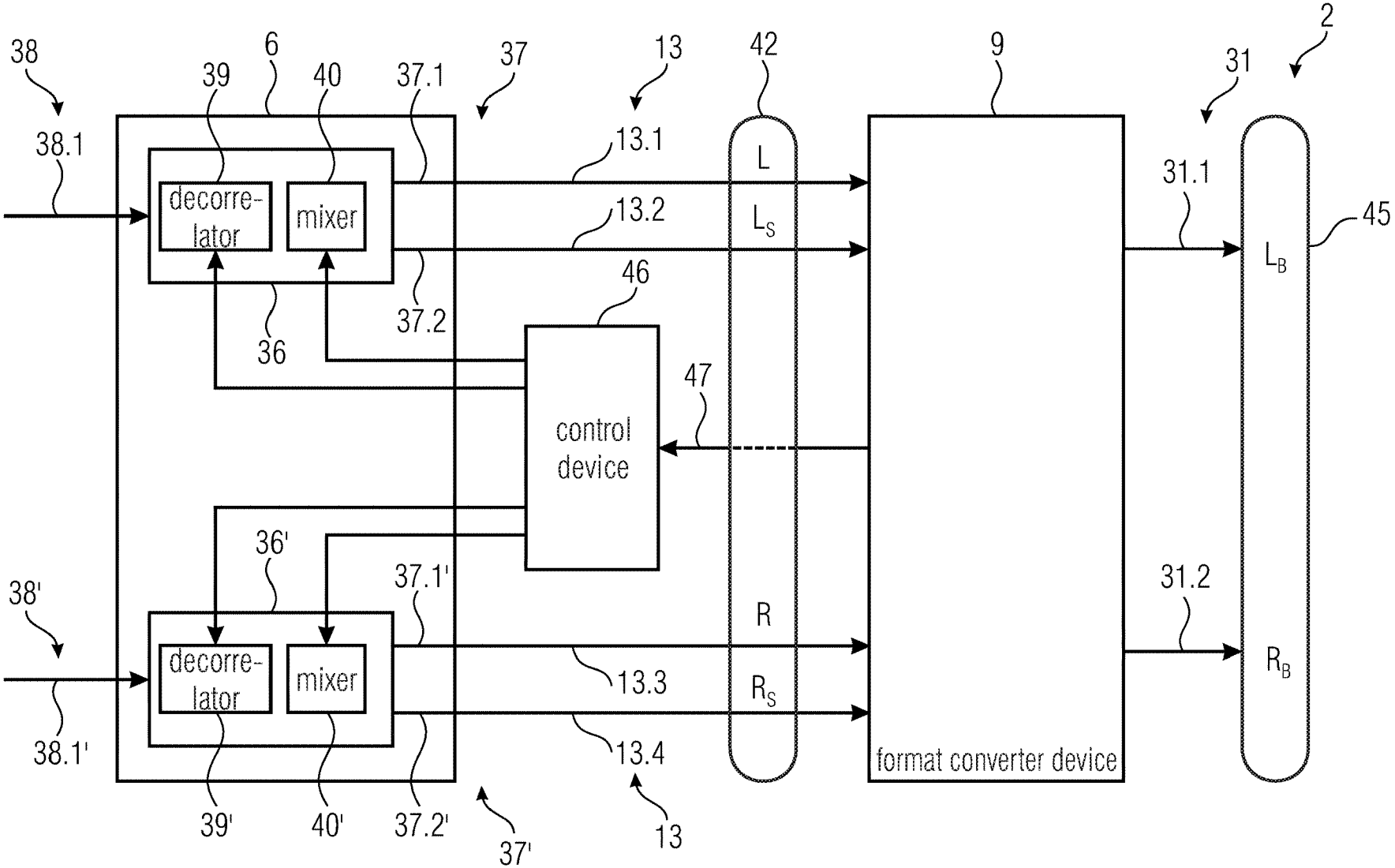
FIG. 2 shows a block diagram of a second embodiment of a decoder according to the invention.

FIG. 2 shows a block diagram of a second embodiment of a decoder according to the invention. In the following only the differences to the first embodiment will be discussed. In FIG. 2 the format converter 9, 10 comprises a binaural renderer 9. Binaural renderers 9 are generally used to convert a multi-channel signal into a stereo signal adapted for the use with stereo headphones. The binaural renderer 9 produces a binaural downmix LB and RB of the multichannel signal fed to it, such that each channel of this signal is represented by a virtual sound source. The multichannel signal may have up to 32 channels or more. However, in FIG. 2 a four channel signal is shown to simplify matters. The processing may be conducted frame-wise in a quadrature mirror filter (QMF) domain. The binauralization is based on measured binaural room impulse responses and causes extremely high computational complexity, which correlates with the number of incoherent/uncorrelated channels of the signal fed to the binaural renderer 9. In order to reduce the computational complexity, at least one of the decorrelators 39, 39' may be switched off.

In the embodiment of FIG. 2 the core decoder output signal 13 is fed the binaural renderer 9 as a binaural renderer input signal 13. In in this case the control device 46 usually is configured to control the processors of the core decoder 6 in such way that a number of the channels 13.1, 13.2, 13.3, 13.4 of the core decoder output signal 13 is greater as the number of loudspeakers of the headphones. This may be desired, for example, as the binaural renderer 9 may use the spatial sound information contained in the channels for adjusting the frequency characteristics of the stereo signal fed to the headphones in order to generate a three-dimensional audio impression.

In embodiments not shown a downmixer output signal of the downmixer 10 is fed to the binaural renderer 9 as a binaural renderer input signal. In case that the output audio signal of the downmixer 10 is fed to the binaural renderer 9, the number of channels of its input signal is significantly smaller than in cases, in which the core decoder output signal 13 is fed to the binaural renderer 9, so that computational complexity is reduced.

Figure 3:
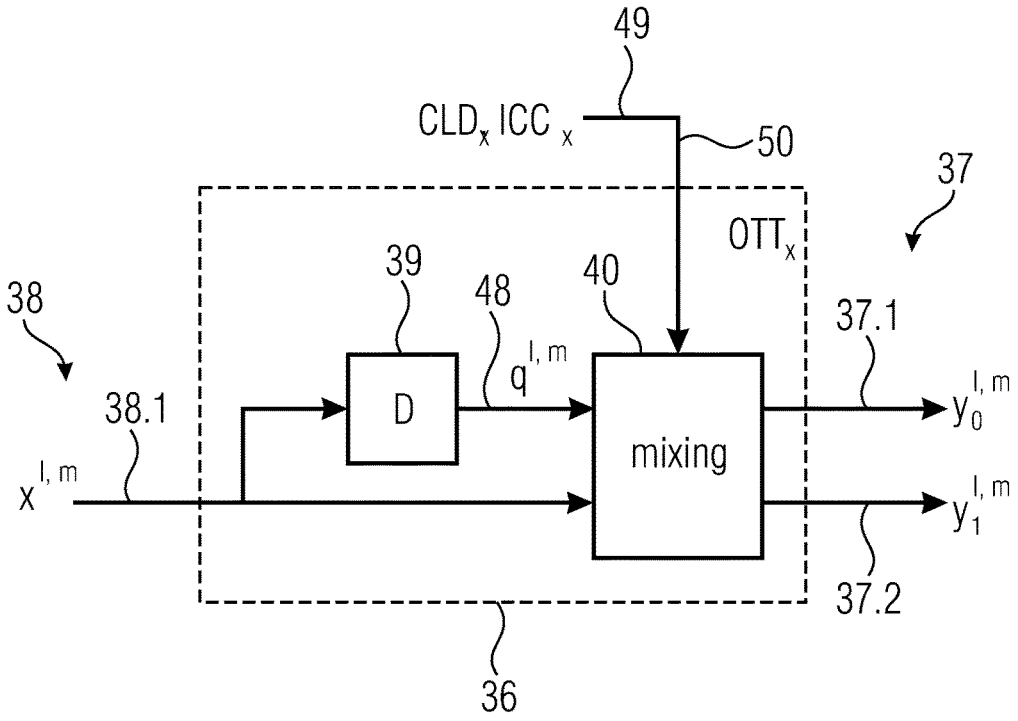
FIG. 3 shows a model of a conceptual processor, wherein the decorrelator is switched on, FIG. 4 shows a model of a conceptual processor, wherein the decorrelator is switched off.
Figure 4:
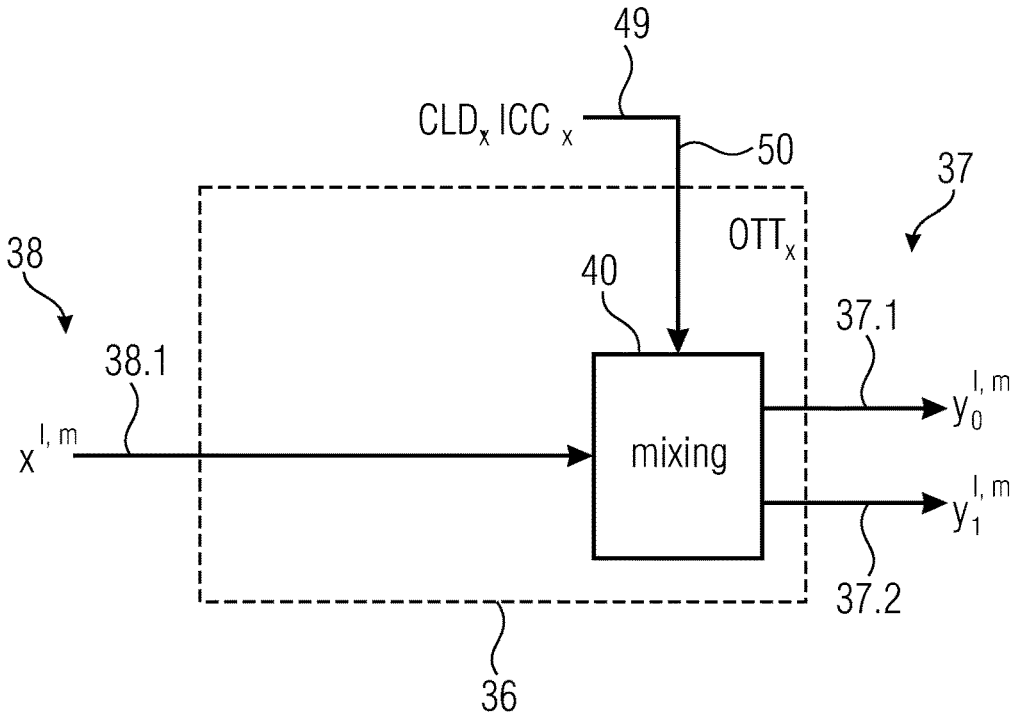

In advantageous embodiments the processor 36 is a one input two output decoding tool (OTT) 36 as shown in FIG. 3 and FIG. 4.

As shown in FIG. 3 the decorrelator 39 is configured to create a decorrelated signal 48 by decorrelating at least one channel 38.1 of the processor input signal 38, wherein the mixer 40 mixes the processor input audio signal 48 and the decorrelated signal 48 based on a channel level difference (CLD) signal 49 and/or an inter-channel coherence (ICC) signal 50, so that the processor output signal 37 consists of two incoherent output channels 37.1, 37.2.

Such one input to output decoding tool 36 allows creating a processor output signal 37 with pair of channels 37.1, 37.2, which have the correct amplitude and coherence with respect to each other in an easy way. Typically a decorrelator (decorrelation filter) consists of a frequency-dependent pre-delay followed by all-pass (IIR) sections.

In some embodiments the control device is configured to switch off the decorrelator 39 of one of the processors 36 by setting the decorrelated audio signal 48 to zero or by preventing the mixer to mix the decorrelated signal 48 into the processor output signal 37 of the respective processor 36. Both methods allow switching off the decorrelator 39 in an easy way.

Some embodiments may be defined for a multichannel decoder 2 based on "ISO/IEC IS 23003-3 Unified speech and audio coding".

For multi-channel coding USAC is composed of different channel elements. An example for 5.1 audio channels is given below.

Example of Simple Bit Stream Payload

| | numElements | elemIdx | usacElementType[elemIdx] |
|---|---|---|---|
| 5.1 channel output signal | 4 | 1 | ID_USAC_SCE |
| | | 2 | ID_USAC_CPE |
| | | 3 | ID_USAC_CPE |
| | | 4 | ID_USAC_LFE |

Each stereo element ID_USAC_CPE can be configured to use MPEG Surround for mono to stereo upmixing by an OTT 36. As depicted below, each element generates two output channels 37.1, 37.2 with the correct spatial cues by mixing a mono input signal with the output of a decorrelator 39 that is fed with that mono input signal [2][3].

An important building block is the decorrelator 39 which is used to synthesize the correct coherence/correlation of the output channels 37.1, 37.2. Typically the de-correlation filters consist of a frequency-dependent pre-delay followed by all-pass (IIR) sections.

In case the output channels 37.1, 37.2 of one OTT decoding block 36 are downmixed by a subsequent format conversion step, the synthesis of the correct correlation becomes perceptually irrelevant. Hence, for these upmixing blocks the decorrelator 39 can be omitted. This can be accomplished as follows.

Figure 5:
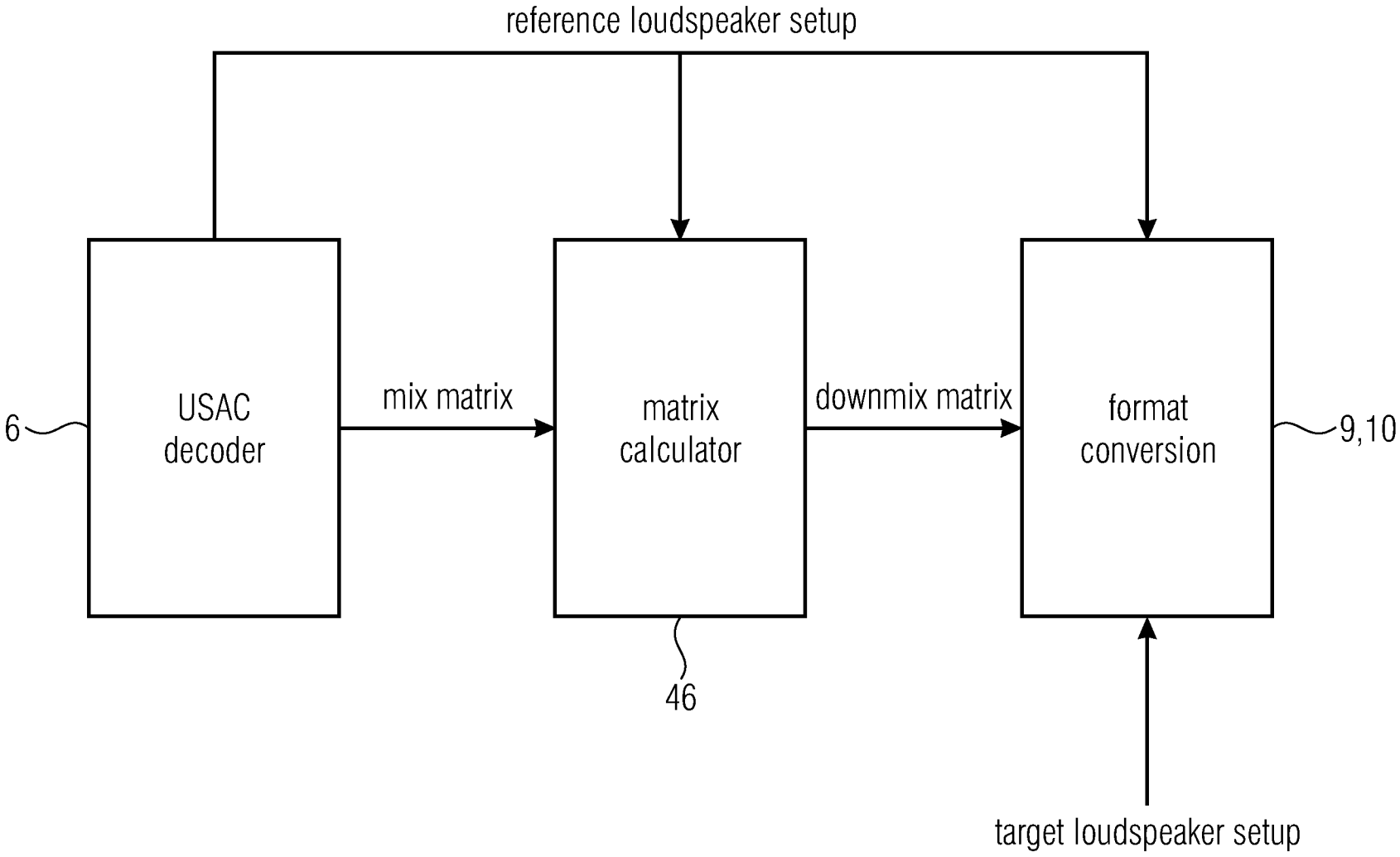
FIG. 5 illustrates an interaction between format conversion and decoding.

An interaction between format conversion 9, 10 and decoding may be established as shown in FIG. 5. Information may be generated whether the output channels of a OTT decoding block 36 are downmixed by a subsequent format conversion step 9, 10. This information is contained in a so called mix matrix, which is generated by a matrix calculator 46 and passed to the USAC decoder 6. The information processed by the matrix calculator is typically the downmix matrix provided by the format conversion module 9, 10.

The format conversion processing block 9, 10 converts the audio data to be suitable for playback on a loudspeaker setup 45, which can differ from the reference loudspeaker setup 42. This setup is called target loudspeaker setup 45.

Downmixing describes the case when a lower number of loudspeakers than is present in the reference loudspeaker setup 42 is used in the target loudspeaker setup 45.

Figure 6:
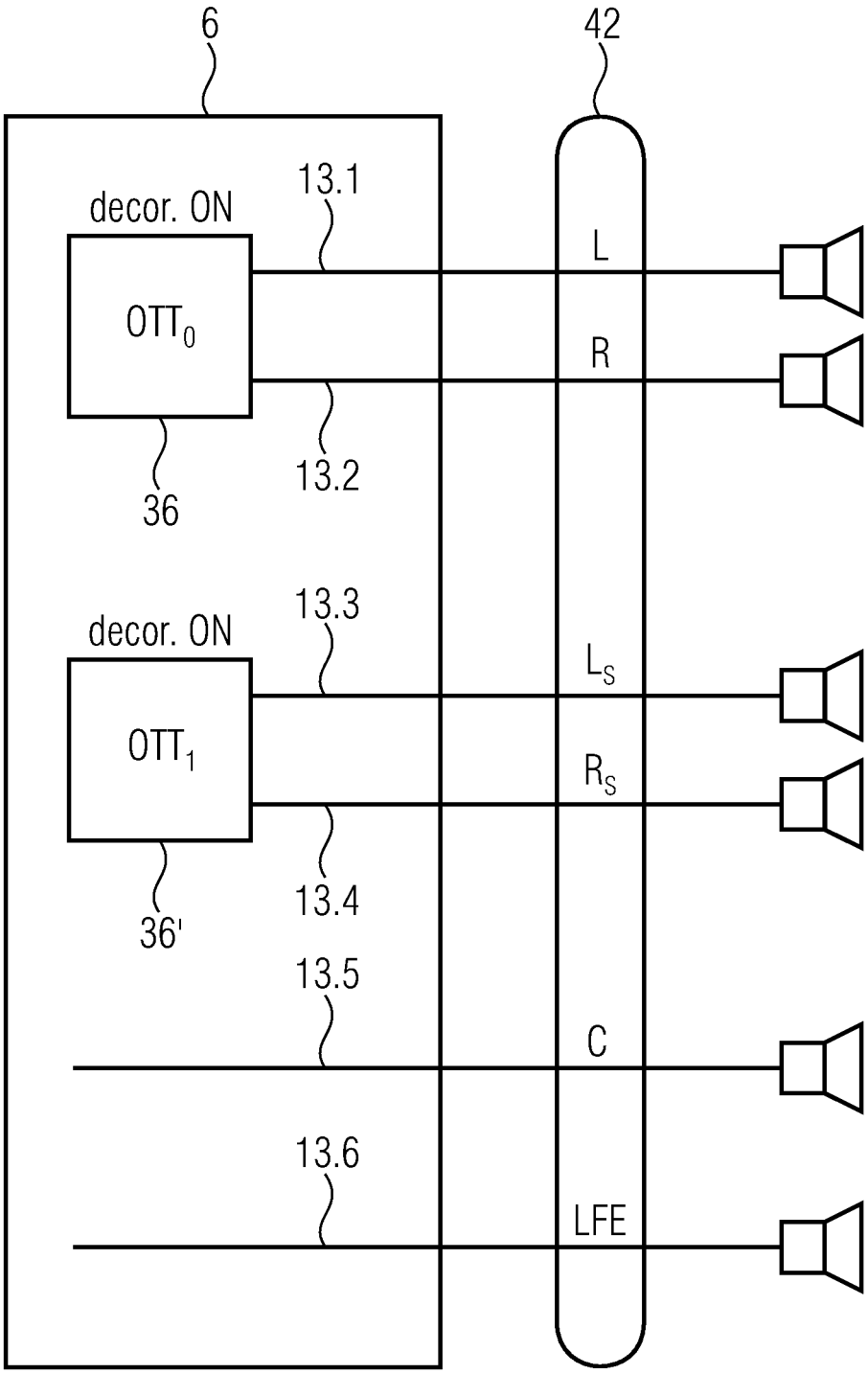
FIG. 6 shows a block diagram of a detail of an embodiment of a decoder according to the invention, wherein a 5.1 channel signal is generated.

In FIG. 6 a core decoder 6 is shown, which provides a core decoder output signal comprising the output channels 13.1 to 13.6 suitable for a 5.1 reference loudspeaker set up 42, which comprises a left front loudspeaker channel L, a right front loudspeaker channel R, a left surround loudspeaker channel LS, a right surround loudspeaker channel RS, a center front loudspeaker channel C and a low frequency enhancement loudspeaker channel LFE. The output channels 13.1 and 13.2 are created by the processor 36 on the basis of channel pair elements (ID_USAC_CPE), which are fed to the processor 36, as decorrelated channels 13.1 and 13.2, when the decorrelator 39 of the processor 36 is switched on.

The left front loudspeaker channel L, the right front loudspeaker channel R, the left surround loudspeaker channel LS, the right surround loudspeaker channel RS and the center front loudspeaker channel C are main channels, whereas the low frequency enhancement loudspeaker channel LFE is optional.

In the same way the output channels 13.3 and 13.4 are created by the processor 36' on the basis of channel pair elements (ID_USAC_CPE), which are fed to the processor 36', as decorrelated channels 13.3 and 13.4, when the decorrelator 39' of the processor 36' is switched on.

The output channel 13.5 is based on single channel elements (ID_USAC_SCE), whereas the output channel 13.6 is based on low frequency enhancement elements ID_USAC_LFE.

In case that six suitable loudspeakers are available, the core decoder output signal 13 may be used for playback without any downmixing. However, in case that only a stereo loudspeaker set is available, the core decoder output signal 13 may be downmixed.

Typically the downmixing processing can be described by a downmix matrix which defines scaling factors for each source channel to each target channel.

E.g. ITU BS775 defines the following downmix matrix for downmixing 5.1 main channels to stereo, which maps the channels L, R, C, LS and RS to the stereo channels L' and R'.

$$M_{DMX} = \begin{pmatrix} 1,0 & 0,0 & 0,7071 & 0,701 & 0,0 \\ 0,0 & 1,0 & 0,7071 & 0,0 & 0,7071 \end{pmatrix}$$

The downmix matrix has the dimension m×n where n is the number of source channels and m is the number of destination channels.

From the downmix matrix $M_{DMX}$ a so called mix matrix $M_{Mix}$ is deduced in the matrix calculator processing block, which describes which of the source channels are being combined. It has the dimension n×n.

$$M_{Mix}(i, j) = \begin{cases} 1, & \text{if channel and channel are combined by downmixing} \\ 0, & \text{otherwise} \end{cases}$$

Please note that $M_{Mix}$ is a symmetric matrix.

For the above example of downmixing 5 channels to stereo the mix matrix $M_{Mix}$ is as follows:

$$M_{Mix} = \begin{pmatrix} 1 & 0 & 1 & 1 & 0 \\ 0 & 1 & 1 & 0 & 1 \\ 1 & 1 & 1 & 1 & 1 \\ 1 & 0 & 1 & 1 & 0 \\ 0 & 1 & 1 & 0 & 1 \end{pmatrix}$$

A method for obtaining the Mix Matrix is given by the following pseudo code:

```
M_Mix = zero n × n Matrix
for i = 1 to m
    for j = 1 to n
        set_j = 0
        if M_Dmx(i, j) > thr
            set_j = 1
        end
        for k = 1 to n
            set_k = 0
            if M_Dmx(i, k) > thr
                set_k = 1
            end
            if set_j == 1 and set_k == 1
                M_Mix(j, k)= 1
            end
        end
    end
end
```

As an example the threshold thr can be set to zero.

Each OTT decoding block yields two output channels corresponding to channel number i and j. If the mix matrix $M_{Mix}(i,j)$ equals one, decorrelation is switched off for this decoding block.

To omit of the decorrelator 39 the elements $q^{l,m}$ are set to zero. Alternatively the decorrelation path can be omitted, as depicted below.

This results in the elements $H12_{OTT}^{l,m}$ and $H22_{OTT}^{l,m}$ of the upmix matrix $R_2^{l,m}$ being set to zero or being omitted, respectively. (See "6.5.3.2 Derivation of arbitrary matrix element" of Ref. [2] for details).

In another embodiment the elements $H11_{OTT}^{l,m}$ and $H21_{OTT}^{l,m}$ of the upmix matrix $R_2^{l,m}$ shall be calculated by setting $ICC^{l,m}=1$.

Figure 7:
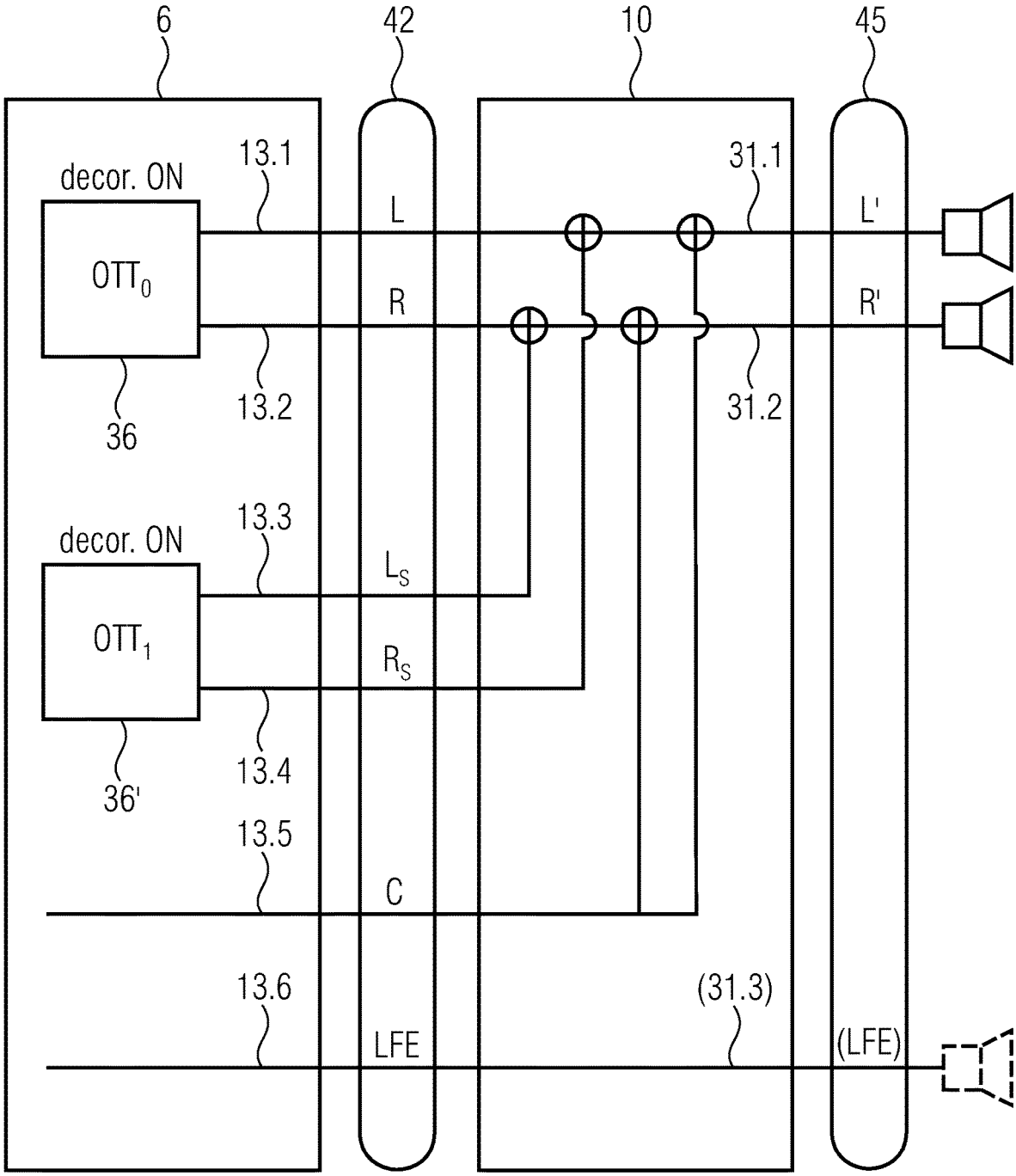
FIG. 7 shows a block diagram of a detail of the embodiment of FIG. 6 of a decoder according to the invention, wherein the 5.1 channel is downmixed to a 2.0 channel signal.

FIG. 7 illustrates the downmix of the main channels L, R, LS, LR, and C to stereo channels L' and R'. As the channels L and R created by the processor 36 are not mixed in a common channel of the output audio signal 31, the decorrelator 39 of the processor 36 remains switched on. In the same way, the decorrelator 39' of the processor 36' remains switched on as the channels LS and RS created by the processor 36' are not mixed in a common channel of the output audio signal 31. The low frequency enhancement loudspeaker channel LFE might be used optionally.

Figure 8:
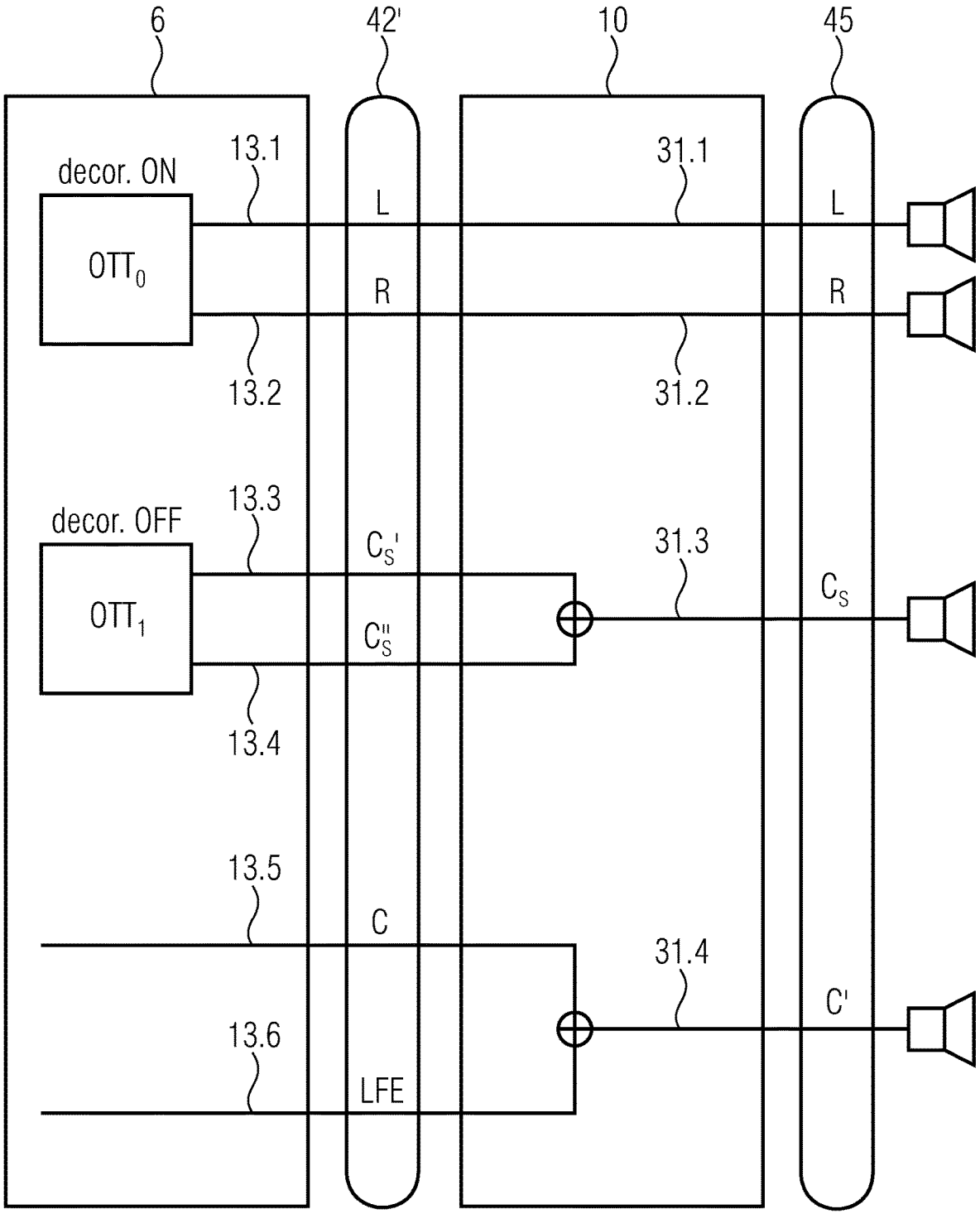
FIG. 8 shows a block diagram of a detail of the embodiment of FIG. 6 of a decoder according to the invention, wherein the 5.1 channel signal is downmixed to a 4.0 channel signal.

FIG. 8 illustrates a downmix of the 5.1 reference loudspeaker set up 42 shown in FIG. 6 to a 4.0 target loudspeaker setup 45. As the channels L and R created by the processor 36 are not mixed in a common channel of the output audio signal 31, the decorrelator 39 of the processor 36 remains switched on. However, the channels 13.3 (LS in FIG. 6) and 13.4 (RS in FIG. 6) created by the processor 36' are mixed in a common channel 31.3 of the output audio signal 31 in order to form a center surround loudspeaker channel CS. Therefore, the decorrelator 39' of the processor 36' is switched off, so that the channel 13.3 is a center surround loudspeaker channel CS' and so that the channel 13.4 is a center surround loudspeaker channel CS". By doing so, a modified reference loudspeaker setup 42' is generated. Note that the channels CS' and CS" are correlated but not identical.

For completeness it has to be added that the channels 13.5 (C) and 13.6 (LFE) are mixed in a common channel 31.4 of the output audio signal 31 in order to form a center front loudspeaker channel C.

Figure 9:
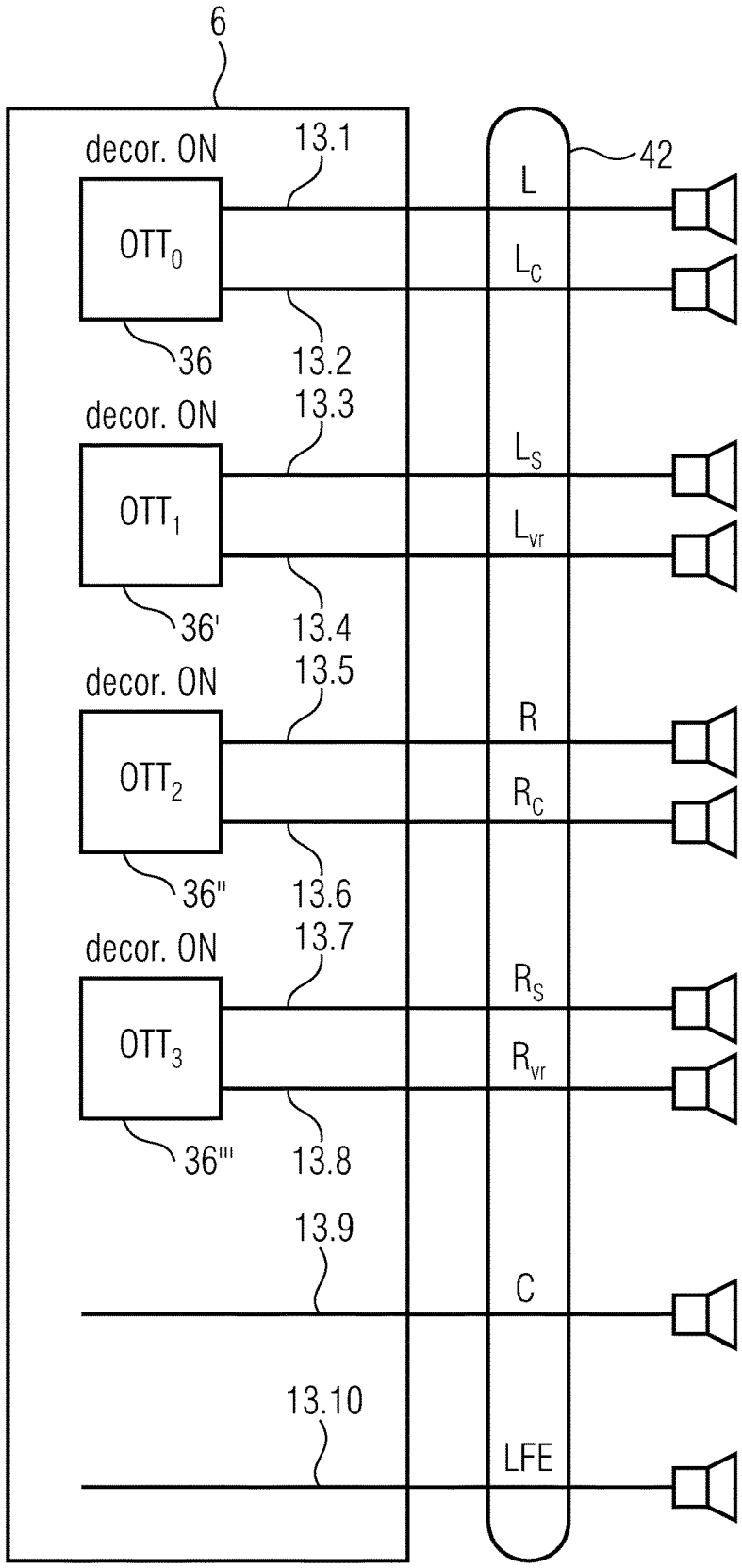
FIG. 9 shows a block diagram of a detail of an embodiment of a decoder according to the invention, wherein a 9.1 channel signal is generated.

In FIG. 9 a core decoder 6 is shown, which provides a core decoder output signal 13 comprising the output channels 13.1 to 13.10 suitable for a 9.1 reference loudspeaker set up 42, which comprises a left front loudspeaker channel L, a left front center loudspeaker channel LC, a left surround loudspeaker channel LS, a left surround vertical height rear LVR, a right front loudspeaker channel R, a right surround loudspeaker channel RS, a right front center loudspeaker channel RC, a right surround loudspeaker channel RS, a left surround vertical height rear RVR, a center front loudspeaker channel C and a low frequency enhancement loudspeaker channel LFE.

The output channels 13.1 and 13.2 are created by the processor 36 on the basis of channel pair elements (ID_USAC_CPE), which are fed to the processor 36, as decorrelated channels 13.1 and 13.2, when the decorrelator 39 of the processor 36 is switched on.

Analogous the output channels 13.3 and 13.4 are created by the processor 36' on the basis of channel pair elements (ID_USAC_CPE), which are fed to the processor 36', as decorrelated channels 13.3 and 13.4, when the decorrelator 39' of the processor 36' is switched on.

Further, the output channels 13.5 and 13.6 are created by the processor 36" on the basis of channel pair elements (ID_USAC_CPE), which are fed to the processor 36", as decorrelated channels 13.5 and 13.6, when the decorrelator 39" of the processor 36" is switched on.

Moreover, the output channels 13.7 and 13.8 are created by the processor 36'" on the basis of channel pair elements (ID_USAC_CPE), which are fed to the processor 36'", as decorrelated channels 13.7 and 13.8, when the decorrelator 39'" of the processor 36'" is switched on.

The output channel 13.9 is based on single channel elements (ID_USAC_SCE), whereas the output channel 13.10 is based on low frequency enhancement elements ID_USAC_LFE.

Figure 10:
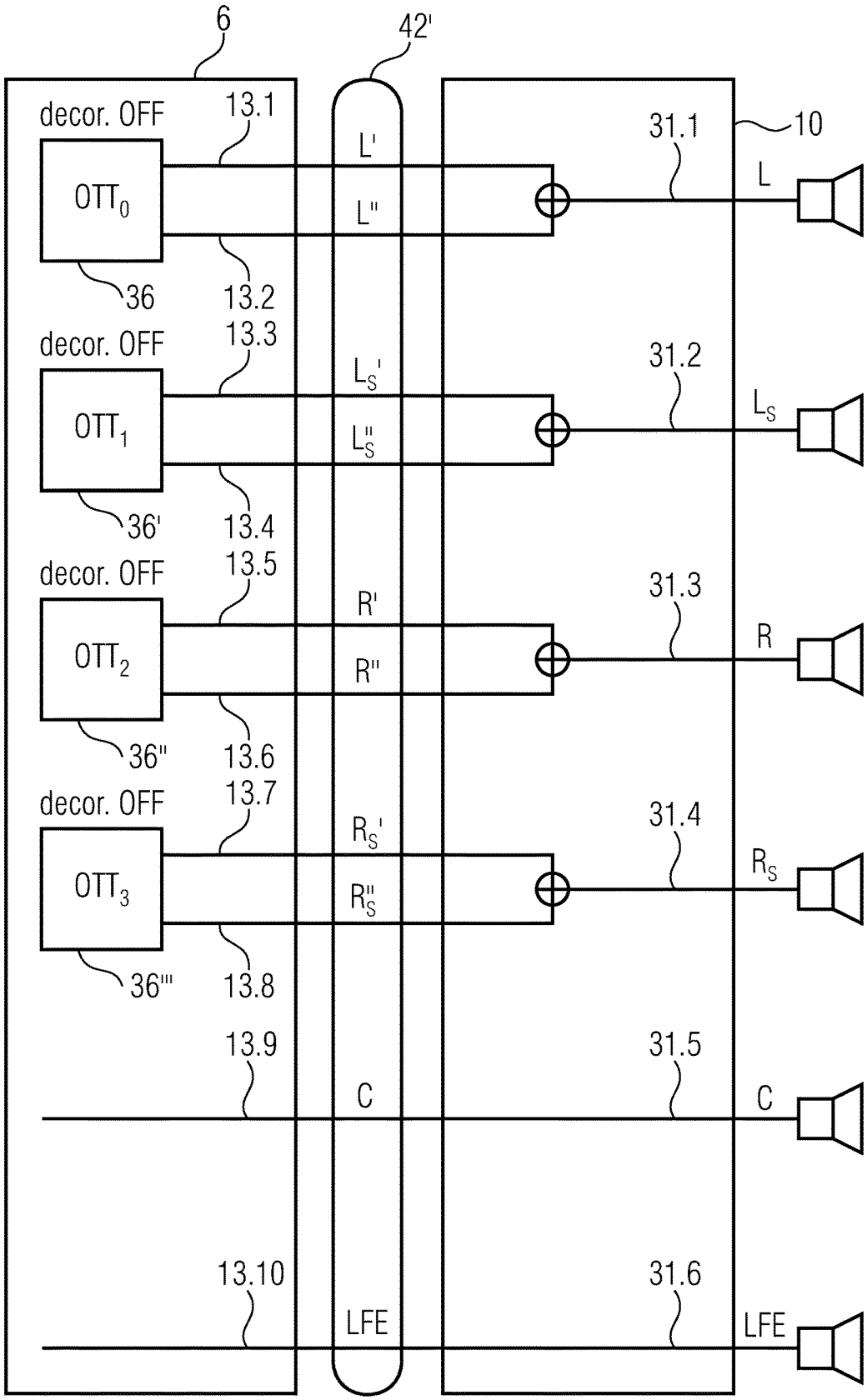
FIG. 10 shows a block diagram of a detail of the embodiment of FIG. 9 of a decoder according to the invention, wherein the 9.1 channel signal is downmixed to a 4.0 channel signal.

FIG. 10 illustrates a downmix of the 9.1 reference loudspeaker set up 42 shown in FIG. 9 to a 5.1 target loudspeaker setup 45. As the channels 13.1 and 13.2 created by the processor 36 are mixed in a common channel 31.1 of the output audio signal 31 in order to form a left front loudspeaker channel L', the decorrelator 39 of the processor 36 is switched off, so that the channel 13.1 is a left front loudspeaker channel L' and so that the channel 13.2 is a left front loudspeaker channel L".

Further, the channels 13.3 and 13.4 created by the processor 36' are mixed in a common channel 31.2 of the output audio signal 31 in order to form a left surround loudspeaker channel LS. Therefore, the decorrelator 39' of the processor 36' is switched off, so that the channel 13.3 is a left surround loudspeaker channel LS' and so that the channel 13.4 is a left surround loudspeaker channel LS".

As the channels 13.5 and 13.6 created by the processor 36" are mixed in a common channel 31.3 of the output audio signal 31 in order to form a right front loudspeaker channel L, the decorrelator 39" of the processor 36" is switched off, so that the channel 13.5 is a right front loudspeaker channel R' and so that the channel 13.2 is a right front loudspeaker channel R".

Moreover, the channels 13.7 and 13.8 created by the processor 36'" are mixed in a common channel 31.4 of the output audio signal 31 in order to form a right surround loudspeaker channel RS. Therefore, the decorrelator 39'" of the processor 36'" is switched off, so that the channel 13.7 is a right surround loudspeaker channel RS' and so that the channel 13.8 is a right surround loudspeaker channel RS".

By doing so, a modified reference loudspeaker setup 42' is generated, wherein the number of the incoherent channels of the core decoder output signal 13 is equal to the number of the loudspeaker channels of the target set up 45.

It has to be noted that this processing shall only be applied for frequency bands where decorrelation is applied. Frequency bands where residual coding is used are not affected.

A mentioned before, the invention is applicable for binaural rendering. Binaural playback typically happens on headphones and/or mobile devices. There, constraints may exist, which limit the decoder and rendering complexity.

Reduction/Omission of decorrelator processing may be performed. In case the audio signal is eventually processed for binaural playback, it is proposed to omit or reduce decorrelation in all or some OTT decoding blocks.

This avoids artifacts from downmixing audio signals that were decorrelated in the decoder.

The number of decoded output channels for binaural rendering may be reduced. In addition to omit decorrelation, it may be desirable to decode to a lower number of incoherent output channels which then results in a lower number of incoherent input channels for binaural rendering. E.g. original 22.2 channel material, decoding to 5.1 and binaural rendering of only 5 channels instead of 22, if decoding takes place on a mobile device.

To reduce the overall decoder complexity it is proposed to apply the following processing:

A) Define a target loudspeaker setup with a lower number of channels than the original channel configuration. The number of target channels depends on quality and complexity constraints.

To reach the target loudspeaker setup two possibilities B1 and B2 exist, which can also be combined:

B1) Decode to a lower number of channels, i.e. by skipping the complete OTT processing block in the decoder. This necessitates an information path from the binaural renderer into the (USAC) core decoder to control the decoder processing.

B2) Apply a format conversion (i.e. downmixing) step from the original loudspeaker channel configuration or an intermediate channel configuration to the target loudspeaker setup. This can be done in a post processing step after the (USAC) core decoder and does not require an altered decoding process.

Finally step C) is performed:

C) Perform binaural rendering of a lower number of channels.

Application for SAOC decoding

The methods described above can also be applied to parametric object coding (SAOC) processing.

Format conversion with reduction/omission of decorrelator processing may be performed. If format conversion is applied after SAOC decoding, information from the format converter to the SAOC decoder is transmitted. With such information correlation inside the SAOC decoder is controlled to reduce the amount of artificially decorrelated signals. This information can be the full downmix matrix or derived information.

Further, binaural rendering with reduction/omission of decorrelator processing may be executed. In case of parametric object coding (SAOC), decorrelation is applied in the decoding process. The decorrelation processing inside the SAOC decoder should be omitted or reduced if binaural rendering follows.

Moreover, binaural rendering with reduced number of channels may be executed. If binaural playback is applied after SAOC decoding, the SAOC decoder can be configured to render to a lower number of channels, using a downmix matrix which is constructed based on the information from the format converter.

As decorrelation filtering entails substantial computational complexity, the overall decoding workload can largely be reduced by the proposed method.

Although the all pass filters are designed in a way to have minimum impact on the subjective sound quality, it may not be avoided that audible artifacts are introduced. E.g. smearing of transients due to phase distortions or "ringing" of certain frequency components. Therefore, an improvement of audio sound quality can be achieved, as side effects of the decorrelation filtering process are omitted. In addition any unmasking of such decorrelator artifacts by subsequent downmixing, upmixing or binaural processing is avoided.

Additionally, methods for complexity reduction in case of binaural rendering in combination with a (USAC) core decoder or a SAOC decoder have been discussed.

With respect to the decoder and encoder and the methods of the described embodiments the following is mentioned:

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier or a non-transitory storage medium.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] Surround Sound Explained—Part 5. Published in: soundonsound magazine, December 2001.

[2] ISO/IEC IS 23003-1, MPEG audio technologies—Part 1: MPEG Surround.

[3] ISO/IEC IS 23003-3, MPEG audio technologies—Part 3: Unified speech and audio coding.

The invention claimed is:

1. An audio decoder device for decoding a compressed input audio signal comprising at least one core decoder comprising one or more processors for generating a processor output signal based on a processor input signal, wherein a number of output channels of the processor output signal is higher than a number of input channels of the processor input signal, wherein each of the one or more processors comprises a decorrelator and a mixer, wherein a core decoder output signal comprising a plurality of channels comprises the processor output signal, and wherein the core decoder output signal is suitable for a reference loudspeaker setup;

at least one format converter device configured to convert the core decoder output signal into an output audio signal, which is suitable for a target loudspeaker setup, wherein the format converter device comprises a downmixer for downmixing the core decoder output signal; and a control device configured to control at least one of the one or more processors in such way that the decorrelator of the at least one of the one or more processors is controlled independently from the mixer of the at least one of the one or more processors, wherein the control device is configured to control at least one of the decorrelators of the one or more processors depending on the target loudspeaker setup.

2. The decoder device according to claim 1, wherein the control device is configured to deactivate the at least one of the one or more processors so that input channels of the processor input signal are fed to output channels of the processor output signal in an unprocessed form.

3. The decoder device according to claim 1, wherein the at least one of the one or more processors is a one input two output decoding tool, wherein the decorrelator is configured to create a decorrelated signal by decorrelating at least one of the channels of the processor input signal, wherein the mixer mixes the processor input signal and the decorrelated signal based on a channel level difference signal and/or an inter-channel coherence signal, so that the processor output signal comprises two incoherent output channels.

4. The decoder device according to claim 3, wherein the control device is configured to switch off the decorrelator of one of the processors by setting the decorrelated signal to zero or by preventing the mixer to mix the decorrelated signal into the processor output signal of the respective processor.

5. The decoder device according to claim 1, wherein the core decoder is a decoder for both music and speech, wherein the processor input signal of at least one of the processors comprises channel pair elements.

6. The decoder device according to claim 1, wherein the core decoder is a parametric object coder.

7. The decoder device according to claim 1, wherein the number of loudspeakers of the reference loudspeaker setup is higher than a number of loudspeakers of the target loudspeaker setup.

8. The decoder device according to claim 1, wherein the control device is configured to switch off the decorrelators for at least one first of said output channels of the processor output signal and one second of said output channels of the processor output signal, if the first of said output channels and the second of said output channels are, depending on the target loudspeaker setup, mixed into a common channel of the output audio signal, provided a first scaling factor for mixing the first of said output channels into the common channel exceeds a first threshold and/or a second scaling factor for mixing the second of said output channels into the common channel exceeds a second threshold.

9. The decoder device according to claim 1, wherein the control device is configured to receive a set of rules from the format converter device according to which the format converter device mixes the channels of the core decoder output signal into the channels of the output audio signal depending on the target loudspeaker setup, wherein the control device is configured to control the at least one of the processors depending on the received set of rules.

10. The decoder device according to claim 1, wherein the control device is configured to control the decorrelators of the processors in such way that a number of incoherent channels of the core decoder output signal is equal to the number of the channels of the output audio signal.

11. The decoder device according to claim 1, wherein the format converter device comprises a binaural renderer.

12. The decoder device according to claim 11, wherein the core decoder output signal is fed to the binaural renderer as a binaural renderer input signal.

13. The decoder device according to claim 1, wherein the format converter device comprises a binaural renderer, and wherein a downmixer output signal of the downmixer is fed the binaural renderer as a binaural renderer input signal.

14. A method for decoding a compressed input audio signal, the method comprising:

providing at least one core decoder comprising one or more processors for generating a processor output signal based on a processor input signal, wherein a number of output channels of the processor output signal is higher than a number of input channels of the processor input signal, wherein each of the one or more processors comprises a decorrelator and a mixer, wherein a core decoder output signal comprising a plurality of channels comprises the processor output signal, and wherein the core decoder output signal is suitable for a reference loudspeaker setup;

providing at least one format converter device configured to convert the core decoder output signal into an output audio signal, which is suitable for a target loudspeaker setup, wherein the format converter device comprises a downmixer for downmixing the core decoder output signal; and providing a control device configured to control at least one of the one or more processors in such way that the decorrelator of the at least one of the one or more processors is controlled independently from the mixer of the at least one of the one or more processors, wherein the control device is configured to control at least one of the decorrelators of the one or more processors depending on the target loudspeaker setup.

15. A non-transitory digital storage medium having stored thereon a computer program for performing the method for decoding a compressed input audio signal, said method comprising:

providing at least one core decoder comprising one or more processors for generating a processor output signal based on a processor input signal, wherein a number of output channels of the processor output signal is higher than a number of input channels of the processor input signal, wherein each of the one or more processors comprises a decorrelator and a mixer, wherein a core decoder output signal comprising a plurality of channels comprises the processor output signal, and wherein the core decoder output signal is suitable for a reference loudspeaker setup;

providing at least one format converter device configured to convert the core decoder output signal into an output audio signal, which is suitable for a target loudspeaker setup, wherein the format converter device comprises a downmixer for downmixing the core decoder output signal; and providing a control device configured to control at least one of the one or more processors in such way that the decorrelator of the at least one of the one or more processors is controlled independently from the mixer of the at least one of the one or more processors, wherein the control device is configured to control at least one of the decorrelators of the one or more processors depending on the target loudspeaker setup, when said computer program is run by a computer.

* * * * *